US009114407B2

(12) United States Patent
Kitazawa et al.

(10) Patent No.: US 9,114,407 B2
(45) Date of Patent: Aug. 25, 2015

(54) CENTRIFUGAL SEPARATOR WITH ROTOR HAVING PLURALITY OF TRIANGULAR-SHAPED HOLDING CAVITIES AND ROTOR FOR USE IN CENTRIFUGAL SEPARATOR

(75) Inventors: Yoshimitsu Kitazawa, Ibaraki (JP); Masaharu Aizawa, Ibaraki (JP); Kenichi Nemoto, Ibaraki (JP); Jun Sato, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 1145 days.

(21) Appl. No.: 12/827,287

(22) Filed: Jun. 30, 2010

(65) Prior Publication Data

US 2010/0331163 A1 Dec. 30, 2010

(30) Foreign Application Priority Data

Jun. 30, 2009 (JP) ..... P2009-156204
Jun. 30, 2009 (JP) ..... P2009-156205
Jun. 30, 2009 (JP) ..... P2009-156206

(51) Int. Cl.
*B04B 5/04* (2006.01)
*B01L 3/00* (2006.01)

(52) U.S. Cl.
CPC ..... *B04B 5/0414* (2013.01); *B01L 3/5021* (2013.01); *B01L 2300/042* (2013.01)

(58) Field of Classification Search
USPC ..... 366/16–21, 31, 33, 43, 81; 422/548; 494/16–21, 31, 33, 43, 81
See application file for complete search history.

(56) References Cited

U.S. PATENT DOCUMENTS

| | | | | |
|---|---|---|---|---|
| D109,021 | S | 6/1936 | Lloyd | |
| 3,071,316 | A * | 1/1963 | Piemonte et al. | 494/16 |
| 3,265,296 | A * | 8/1966 | Mitchell | 494/16 |
| 3,459,369 | A * | 8/1969 | Marks | 494/38 |
| 3,794,241 | A * | 2/1974 | Szentesi | 494/16 |
| 3,961,745 | A * | 6/1976 | Wright | 494/9 |

(Continued)

FOREIGN PATENT DOCUMENTS

| | | |
|---|---|---|
| DK | 1989 00209 S | 11/1989 |
| DK | 1989 00210 | 11/1989 |

(Continued)

OTHER PUBLICATIONS

Japanese Office Action for the related Japanese Patent Application 2009-156204 dated Dec. 26, 2012.

(Continued)

*Primary Examiner* — Charles Cooley
(74) *Attorney, Agent, or Firm* — Kenealy Vaidya LLP

(57) ABSTRACT

A rotor includes a plurality of holding cavities for holding specimen containers, respectively. A transverse cross sectional shape of the holding cavity is a substantially triangular shape having one vertex on an inner circumference side of the rotor. Two vertices of the substantially triangular shape are arranged on an outer circumference side of the rotor so as to have equidistance from a rotary shaft of the rotor. Spacing between sides of the substantially triangular shape in a circumferential direction of the rotor gradually increase over 60% or more a radial length of the holding cavity from an innermost circumferential position to the outer circumference side of the rotor when viewed in its transverse plane.

20 Claims, 26 Drawing Sheets

(56) References Cited

U.S. PATENT DOCUMENTS

| | | | | |
|---|---|---|---|---|
| 3,970,245 | A * | 7/1976 | Aeschlimann | 494/9 |
| 4,278,437 | A | 7/1981 | Haggar | |
| 4,753,631 | A * | 6/1988 | Romanauskas | 494/9 |
| D308,336 | S | 6/1990 | Delbanco | |
| 4,956,103 | A | 9/1990 | Jessop et al. | |
| 5,071,402 | A | 12/1991 | Weyant, Jr. | |
| 5,295,943 | A | 3/1994 | Romanauskas et al. | |
| 5,344,380 | A | 9/1994 | Chern et al. | |
| 5,411,465 | A * | 5/1995 | Glen et al. | 494/16 |
| 5,533,644 | A * | 7/1996 | Glen et al. | 494/16 |
| 5,558,616 | A * | 9/1996 | Barkus et al. | 494/12 |
| 5,643,168 | A * | 7/1997 | Piramoon et al. | 494/16 |
| 5,667,755 | A * | 9/1997 | Baum et al. | 422/548 |
| 5,759,592 | A | 6/1998 | Piramoon et al. | |
| 5,899,349 | A * | 5/1999 | Moore | 215/277 |
| 6,350,225 | B1 * | 2/2002 | Sheeran et al. | 494/12 |
| D489,271 | S | 5/2004 | Soomar | |
| D496,286 | S | 9/2004 | Krunas | |
| 6,793,885 | B1 | 9/2004 | Yokoi et al. | |
| D500,448 | S | 1/2005 | Krunas | |
| D563,666 | S | 3/2008 | Davis | |
| 7,371,206 | B2 * | 5/2008 | Eigemeier et al. | 494/16 |
| D587,973 | S | 3/2009 | Romano | |
| D624,432 | S | 9/2010 | Fox et al. | |
| D627,657 | S | 11/2010 | Vogler | |
| 8,105,556 | B2 * | 1/2012 | Romanauskas et al. | 422/548 |
| D653,554 | S | 2/2012 | Kitazawa et al. | |
| 2006/0183620 | A1 * | 8/2006 | Eigemeier et al. | 494/16 |
| 2008/0248939 | A1 | 10/2008 | Shimizu et al. | |
| 2009/0054221 | A1 * | 2/2009 | Baird et al. | 494/12 |
| 2010/0331163 | A1 * | 12/2010 | Kitazawa et al. | 494/20 |
| 2011/0319247 | A1 * | 12/2011 | Kitazawa et al. | 494/16 |
| 2013/0316889 | A1 * | 11/2013 | Asakura et al. | 494/43 |

FOREIGN PATENT DOCUMENTS

| | | | |
|---|---|---|---|
| EP | 0 076 772 | A2 | 4/1983 |
| JP | 58-76154 | A | 5/1983 |
| JP | 63-42755 | A | 2/1988 |
| JP | 5-501673 | A | 4/1993 |
| JP | 7-501747 | A | 2/1995 |
| JP | 2000-74910 | A | 3/2000 |
| JP | 2002-517160 | A | 6/2002 |
| JP | 2003-519003 | A | 6/2003 |
| JP | 2003-305381 | A | 10/2003 |
| JP | 2004-290746 | A | 10/2004 |
| JP | 2006-175439 | A | 7/2006 |
| JP | 2007-21277 | A | 2/2007 |
| JP | 2007-111577 | A | 5/2007 |
| JP | 2008-119649 | A | 5/2008 |
| JP | 2008-229500 | A | 10/2008 |
| JP | 2010-536563 | A | 12/2010 |
| WO | 92/11092 | A1 | 7/1992 |
| WO | 96/35156 | A1 | 11/1996 |

OTHER PUBLICATIONS

Japanese Office Action for the related Japanese Patent Application 2009-156206 dated Dec. 28, 2012.

Japanese Office Action Apr. 27, 2010 (English translation provided).

Japanese Office Action for the related Japanese Patent Application 2009-156204 dated Dec. 26, 2012 and Dec. 28, 2012.

Japanese Office Action for the related Japanese Patent Application No. 2009-156205 dated Oct. 30, 2012.

The Extended European Search Report for the related European Patent Application No. 10006734.7 dated Dec. 11, 2012.

The partial European Search Report for the related European Patent Application No. 11005277.6 dated Dec. 11, 2012.

The European Office Action for the related European Patent Application No. 10006734.7 dated Jul. 15, 2014.

* cited by examiner

CENTRIFUGAL SEPARATOR WITH ROTOR HAVING PLURALITY OF TRIANGULAR-SHAPED HOLDING CAVITIES AND ROTOR FOR USE IN CENTRIFUGAL SEPARATOR

BACKGROUND OF THE INVENTION

The present invention relates to a centrifugal separator used in fields of medical science, pharmaceutical science, biogenetics, chemical engineering, food manufacturing, manufacture of pharmaceutical products, and the like, and, more particularly, a centrifugal separator having an angle rotor capable of increasing an amount of liquid specimen which can be processed at a time.

A centrifugal separator used for separating a liquid specimen includes: a rotor that holds a plurality of specimen containers containing liquid specimens in specimen container holding cavities equally arranged along a circumference of the rotor; and drive means, such as a motor, that rotationally drives the rotor in a rotor chamber. The centrifugal separator rotates the rotor in the rotor chamber under atmospheric pressure or reduced pressure at high speed, thereby centrifugally separating liquid specimens in the specimen containers to collect objects. The centrifugal separator that is a primary subject of the present invention achieves a maximum rotational speed of the order of 5,000 to 30,000 rpm and can employ as usage rotors having various specifications.

Liquid specimens include various liquids, such as blood components, a culture solution for a fungus body or a virus, living-body components like liquids including DNA and RNA, polymer suspension, ink, and food processing fluids. These liquid specimens are subjected to centrifugal separation for various purposes during processes, like a research, a test, an inspection, and manufacture.

A known rotor for use in a centrifugal separator is described in connection with; for instance, JP2008-119649A. FIG. 21 shows a side view of a related-art angle rotor 130, and a left half of the drawing shows a cross section of the rotor. In FIG. 21, a plurality of specimen container holding cavities 132 (only one of them is illustrated in FIG. 21) are made at equal angular pitches along a circumference of the rotor 130. A specimen container 150 filled with a liquid specimen is inserted into each of the holding cavities 132. A rotor cover 140 is attached to an opening in an upper surface of the rotor 130, and the rotor cover 140 is fixed to a rotor body 131 by means of a handle 141, whereby an interior of the rotor 130 is sealed. A drive shaft hole 131A is formed in a lower portion of a center shaft of the rotor body 131. The drive shaft hole 131A is attached to a drive 112 connected to a drive shaft (not shown) of the centrifugal separator. The rotor 130 is rotated at predetermined speed by drive means.

FIG. 22 is an oblique perspective view showing a shape of the specimen container 150 that has been known in connection with JP2004-290746A and that is to be attached to any of the holding cavities 132 of the related-art rotor body 131. In the centrifugal separator using specimen containers with caps, a body 151 of the specimen container 150 is columnar. A screw cap 152 is attached to an upper portion of the body 151, to thereby seal a liquid specimen. The cap 152 is made up of an inner cap and an outer cap. The specimen container 150 is usually embodied as a molded article using plastic materials, such as polypropylene, polycarbonate, polystyrene, and polyethylene terephthalate. The specimen container is usually reused again and again in many cases. Each of the body 151 and the cap 152 assumes a square transverse section. When inserted into the holding cavity 132 of the rotor 130, the body and the cap can be attached to the rotor at an arbitrary position with little concern for a rotational position determined with reference to a longitudinal center axis of the specimen container 150. The word "transverse plane" used herein means a cross-sectional plane perpendicular to the vertical direction of the specimen container.

In relation to the specimen container 150 with a cap that is employed in the angle rotor 130, specimen containers having a capacity of the order of 2 ml/container to a capacity of the order of 1000 ml/container have already been commercialized as usage. There are also available various rotors in which the number of specimen container holding cavities 132 made in the rotor 130 ranges from four/rotor to 20/rotor, or thereabouts. The rotor 130 is generally manufactured from a lightweight, high-intensity aluminum alloy, a titanium alloy, a carbon fiber composite material, and the like. In relation to the rotor 130, commercialized rotors include; for instance, a rotor capable of containing six specimen containers each of which has a capacity of 30 ml (hereinafter called a "300 ml-by-six"); a 500 ml-by-six rotor; and large-capacity angle rotors, such as a 1000 ml-by-four rotor, a 1000 ml-by-five rotor, and a 1000 ml-by-six rotor. An increase in the size of the rotor body proceeds with the changing times. Moreover, the size of the rotor body also becomes greater as the capacity of the specimen container becomes greater. In the case of for instance, rotors whose specimen containers have a capacity of 300 ml to 1000 ml, the maximum diameter of a rotor body is in excess of 300 mm.

Incidentally, removal and attachment of a rotor to a centrifugal separator is performed by an operator. Manufacturers of centrifugal separators including the present patent applicant have made efforts to lessen a weight of the rotor and enhance operability of the same by making structural contrivance to the rotor. Further, attempts have also been made to increase a capacity of a specimen that can be subjected to centrifugal separation at a time, by increasing the size of the specimen container. In recent years, a centrifugal separator using a large-capacity 1000 ml-by-four angle rotor has widely been used. Moreover, a disclosed specimen container is equipped with a cap, such as that described in connection with JP2004-290746A in which through holes 152A for ejection purpose are made in the cap 152, thereby facilitating ejection of the specimen containers and preventing leakage of a specimen in the course of centrifugal separation.

In order to efficiently collect an object from a liquid specimen during a centrifugal separation process, a common practice is to increase rotational speed of the rotor so as to increase centrifugal acceleration imparted to a liquid specimen and enhance a centrifugal effect, thereby accelerating spin-down of the object, increasing a collect rate, and increasing an amount of specimen capable of being processed at a time. A reduction in expenses to be incurred in centrifugal separation operation is important in inexpensively constructing a specimen container and a centrifugal separator including a rotor. However, it is also important to increase an amount of specimen capable of being subjected to centrifugal separation at a time, thereby increasing a yield.

In order to subject a large quantity of liquid specimen to centrifugal separation at a time, it is effective to increase the number of specimen containers used in the rotor and capacities of the respective specimen containers. However, in order to increase the capacity of the related-art columnar specimen container without modifications, it is necessary to increase an outer diameter or height of the body 151. As a result, the specimen container holding cavity of the rotor comes to interfere with adjacent holding cavities; hence, it is necessary to relocate the positions of the holding cavities in a radially distal direction (toward an outer circumference) from a rotation center. As a consequence, the diameter of the rotor itself increases, which in turn results in an increase in the weight of the rotor, thereby worsening worker's portability of a rotor and ease of detachment/attachment of a rotor to a centrifugal separator performed by the worker.

Further, an increase in the diameter of the rotor leads to an increase in air resistance (a windage loss) arising when the centrifugal separator rotates at high speed. Therefore, required countermeasures include an increase in power of a drive unit of the centrifugal separator and power of a cooling unit for cooling the rotor. An additional necessity is to increase the size of the rotor chamber (chamber) of the centrifugal separator in association with an increase in the diameter of the rotor. A footprint of the centrifugal separator increases, thereby raising a problem of an increase in the cost of the centrifugal separator.

During the course of resolution of these drawbacks, the present inventors focused an attention on presence of a constituent material (hereinafter called "pads") of the rotor, which is a cause for an increase in weight, between adjacent specimen container holding cavities when the rotor including columnar specimen containers is viewed from above, and improvements have been made to minimize the pads. Further, during the course of achievement of improvements, it was found that the pads located in the vicinity of the outer circumference of the rotor became a cause for an increase in the weight of the rotor and that centrifugal load exerted on the pads became a cause for deterioration of strength of the rotor.

SUMMARY OF THE INVENTION

The present invention has been conceived against the backdrop and aims at realizing a centrifugal separator that has achieved an increase in an amount of specimen capable of being subjected to centrifugal separation at a time while preventing an increase in a diameter and a weight of a rotor.

The present invention also aims at providing a centrifugal separator that enables efficient performance of work within a short period of time by enhancing a centrifugal separation characteristic.

The present invention further aims at providing a centrifugal separator that uses large-capacity specimen containers exhibiting superior ease of use.

Characteristics of typical inventions of inventions described in connection with the present patent application are described as follows.

(1) A rotor comprising a plurality of holding cavities for holding specimen containers, respectively, wherein a transverse cross sectional shape of the holding cavity is a substantially triangular shape having one vertex on an inner circumference side of the rotor, wherein two vertices of the substantially triangular shape are arranged on an outer circumference side of the rotor so as to have equidistance from a rotary shaft of the rotor, and wherein spacing between sides of the substantially triangular shape in a circumferential direction of the rotor gradually increase over 60% or more a radial length of the holding cavity from an innermost circumferential position to the outer circumference side of the rotor when viewed in its transverse plane.

(2) The rotor according to (1), wherein tangential lines of two sides that form the vertex located on the inner circumference side of the substantial triangle make an angle of 45° or more and under 90°.

(3) The rotor according to (2), wherein each angle made by two of tangential lines of the respective sides of the holding cavity is 60°.

(4) The rotor according to (3), wherein a transverse cross sectional shape of the specimen container is a substantially equilateral triangle, and the specimen container can be inserted into the holding cavity of the rotor at a plurality of positions turned in a circumferential direction.

(5) The rotor according to (4), wherein the rotor has a diameter ranging from 350 mm to 450 mm and a height ranging from 200 mm to 250 mm, and a volume of the specimen container to be inserted into the holding cavity is 1200 milliliters or more.

(6) The rotor according to (5), wherein the holding cavities formed in the rotor are placed in number of four or six at positions symmetrical about a rotary shaft of the rotor.

(7) The rotor according to (6), wherein the rotor is formed from a metallic alloy by integral molding, and the holding cavity is formed so as to tilt with respect to the rotary shaft of the rotor such that a center axis of the holding cavity goes much apart from the rotary shaft of the rotor in a downward direction.

(8) The rotor according to (7), wherein an angle that the holding cavity forms with the rotary shaft of the rotor is 20° or more and under 25° when the number of the holding cavities is four.

(9) The rotor according to (7), wherein an angle that the holding cavity forms with the rotary shaft of the rotor is 15° or more and under 20° when the number of the holding cavities is six.

(10) A centrifugal separator rotor comprising a plurality of holding cavities for holding specimen containers, respectively, wherein a horizontal transverse cross sectional shape of the holding cavity is a substantial triangle having three vertices, and wherein in relation to vertical arrangement of the holding cavity, the holding cavity is formed so as to tilt with respect to a rotary shaft of the rotor such that a turning radius of the holding cavity becomes greater from an opening in an upper portion to a bottom of the hole.

(11) The rotor according to (10), wherein the holding cavity is arranged such that one of the three vertices lying in the transverse plane is located on an innermost circumference of the rotor and that remaining two vertices are located on an outer circumference side of the rotor so as to have equidistance from the rotary shaft of the rotor.

(12) The rotor according to (11), wherein the substantially triangular specimen container whose transverse cross sectional shape has three vertices can be inserted into the holding cavity, and a cap having a circular opening is fitted to a top of the specimen container for closing the opening of the specimen container.

(13) The rotor according to (12), wherein the holding cavity is configured such that, when the specimen container is inserted into the holding cavity, a distance between a vertical center line of the specimen container and an inner wall on an inner side of the specimen container becomes greater than a distance between the vertical center line and an inner wall on an outer side of the specimen container, within a longitudinal cross section including the vertical center line of the specimen container and the rotary shaft of the rotor.

(14) The rotor according to (13), wherein, in an opening of the specimen container, a distance between the vertical center line and the inner wall on the inner side of the opening of the specimen container is equal to a distance between the vertical center line and the inner wall on the outer side of the opening of the specimen container.

(15) The rotor according to (12), wherein three vertices of the specimen container are made at a curvature radius that is smaller than an outer diameter of the cap.

(16) The rotor according to (13), wherein the holding cavity is formed such that an arbitrary one of the three vertices of the specimen container is located on the innermost circumference side of the holding cavity.

(17) A centrifugal separator using the rotor according to (12) comprising:

a drive unit that rotates the rotor; and a chamber forms a rotor chamber that accommodates the rotor.

(18) The centrifugal separator according to (17) further comprising:

a neck support member that has an outer shape identical with that of the specimen container when viewed from above and that has in a center thereof a circular hole for allowing the cap of the specimen container to pass through, and the rotor is rotated while the neck support member is attached to the specimen container.

(19) The centrifugal separator according to (18), wherein spacing between the inner wall of the holding cavity and the outer wall of the specimen container inserted into the holding cavity is between 0.1 mm and 1 mm.

(20) A specimen container for a centrifugal separator comprising:

a body capable of containing a specimen, the body having a circular opening provided on a top of the body;

a cap capable of being attached to the body; and a sealing member through which the cap can be detachably attached to the opening, wherein the body has a substantially triangular outer shape when viewed from above, wherein an outer shape of the body is set such that a distance from a center of a first vertex of the body to a center of a second vertex becomes equal to a distance from the first vertex to a third vertex, wherein tangential lines of two sides that form the first vertex make an angle of 45° or more and under 90°, wherein the first vertex is formed at a first curvature radius when viewed from above, and wherein the sides between the respective vertices are made in a circular-arc shape exhibiting a gentle second curvature radius outside when viewed from above.

(21) The specimen container according to (20), wherein a position of the outer shape of the body is located outside with respect to a position of an outer shape of the cap when viewed from above.

(22) The specimen container according to (21), wherein an angle between tangential lines of two sides that form the first through third vertices is 60°, and equidistance exists between centers of the respective vertices.

(23) The specimen container according to (22), wherein the opening has a third curvature radius, and the respective curvature radii exhibit a relationship of $R1<R3<R2$.

(24) The specimen container according to (23), wherein the second curvature radius is three times or more the third radius curvature.

(25) The specimen container according to (24), in which the second curvature radius is 170 mm or more.

(26) The specimen container according to (21), wherein the specimen container has a shoulder that connects the opening to the respective vertices.

(27) The specimen container according to (20), wherein an angle between tangential lines of two sides that form the first vertex is under 60°, and a distance from the second vertex to the third vertex is shorter than a distance from the first vertex to the second vertex and the third vertex.

(28) The specimen container according to (25), wherein a height of the specimen container is 190 mm or less, a diameter of the cap is 100 mm or less, and a volume of the specimen container is 1500 ml or more.

BRIEF DESCRIPTION OF THE DRAWINGS

FIGS. 7A and 7B are top views of the specimen container 50 of the embodiment of the present invention, wherein FIG. 7A shows the specimen container equipped with a cap 52 and FIG. 7B shows the specimen container from which the cap 52 is removed;

FIGS. 9A and 9B are views showing a shape of a neck support member 70 shown in FIG. 2, wherein FIG. 9A is an oblique perspective view of the neck support member and FIG. 9B is a top view of the neck support member;

FIGS. 19A and 19B are views showing a specimen container 90 of a third embodiment of the present invention, wherein FIG. 19A is a top view and FIG. 19B is an oblique perspective view;

FIGS. 20A and 20B are views showing a specimen container 95 of a fourth embodiment of the present invention, wherein FIG. 19A is a top view and FIG. 19B is an oblique perspective view;

DESCRIPTION OF EXEMPLARY EMBODIMENTS

First Embodiment

Figure 1:
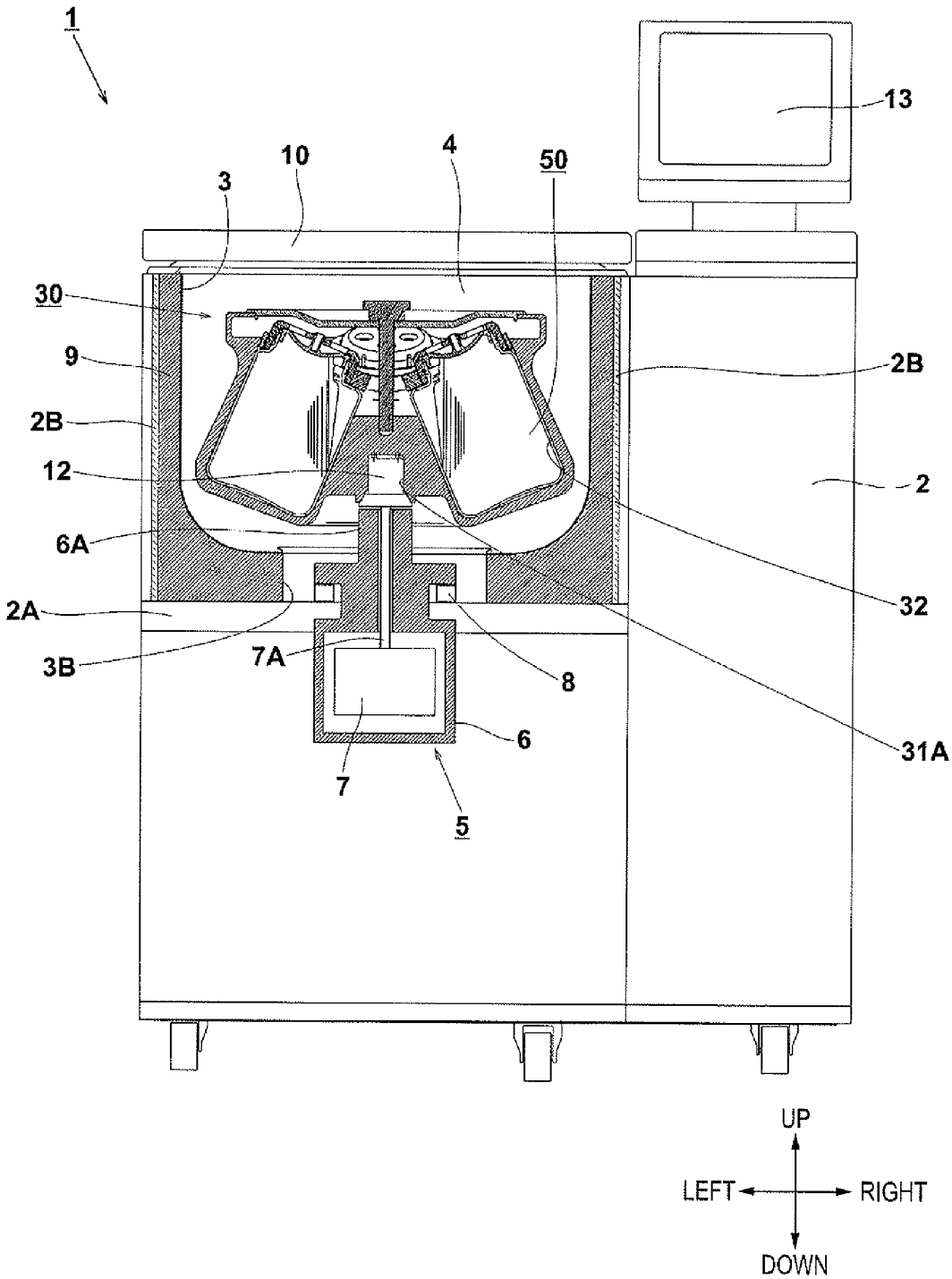
FIG. 1 is a front view of a centrifugal separator 1 of an embodiment of the present invention including its partial cross section.

An embodiment of the present invention is hereinbelow described by reference to the drawings. In the following drawings, like elements are assigned like reference numerals, and their repeated explanations are omitted. Throughout the specification, explanations are provided on an assumption that vertical and horizontal directions of a centrifugal separator are the same as those shown in FIG. 1 and that a vertical direction of a specimen container is identical with that provided in FIG. 3.

FIG. 1 is a front view of a centrifugal separator 1 of the present invention including its partial cross section. The centrifugal separator 1 has a rectangular housing 2, and an interior of the housing 2 is separated into two upper and lower spaces by means of a horizontal partition 2A. A cylindrical, open top chamber 3 is provided in a partitioned upper space. An unillustrated coolant circulating pipe is attached to the outer circumference of the chamber 3, and a coolant supplied from an unillustrated cooler provided in the centrifugal separator 1 is caused to flow through the pipe, thereby cooling an internal space of the chamber 3; namely, a rotor chamber 4. A heat insulation material 9 and a protective barrier 2B are provided around the chamber 3. A reclosable door 10 is provided on an upper side of the chamber 3, and the rotor chamber 4 is sealed by closing the door 10. A rotor 30 is housed in the rotor chamber 4. An operation display 13 is provided at a right position on top of the housing 2.

A drive 5 is mounted to the partition 2A in a lower space partitioned by the partition 2A in the housing 2. The drive 5 includes a motor housing 6, and an electric motor 7 serving as a drive source is disposed in the motor housing 6. The motor housing 6 is fastened to the partition 2A by way of a damper 8. A shaft support 6A is disposed above the motor housing 6 so as to reach an interior of the rotor chamber 4 by way of a bore 3B opened in a bottom of the chamber 3. A rotary shaft 7A of the motor 7 is rotatably supported by the shaft support 6A and upwardly extends up to the interior of the rotor chamber 4. A drive shaft 12 is provided at an upper end of the rotary shaft 7A, and a drive shaft hole 31A of the rotor 30 is secured to the drive shaft 12. The rotor 30 is configured so as to be removably attached to the drive shaft 12, and the rotor 30 is rotated by the motor 7. In normal times, the rotor 30 having holding cavities commensurate with specimen containers used is selectively attached. Specimen containers 50 filled with specimen are inserted into specimen container holding cavities 32 formed in the rotor 30.

Figure 2:
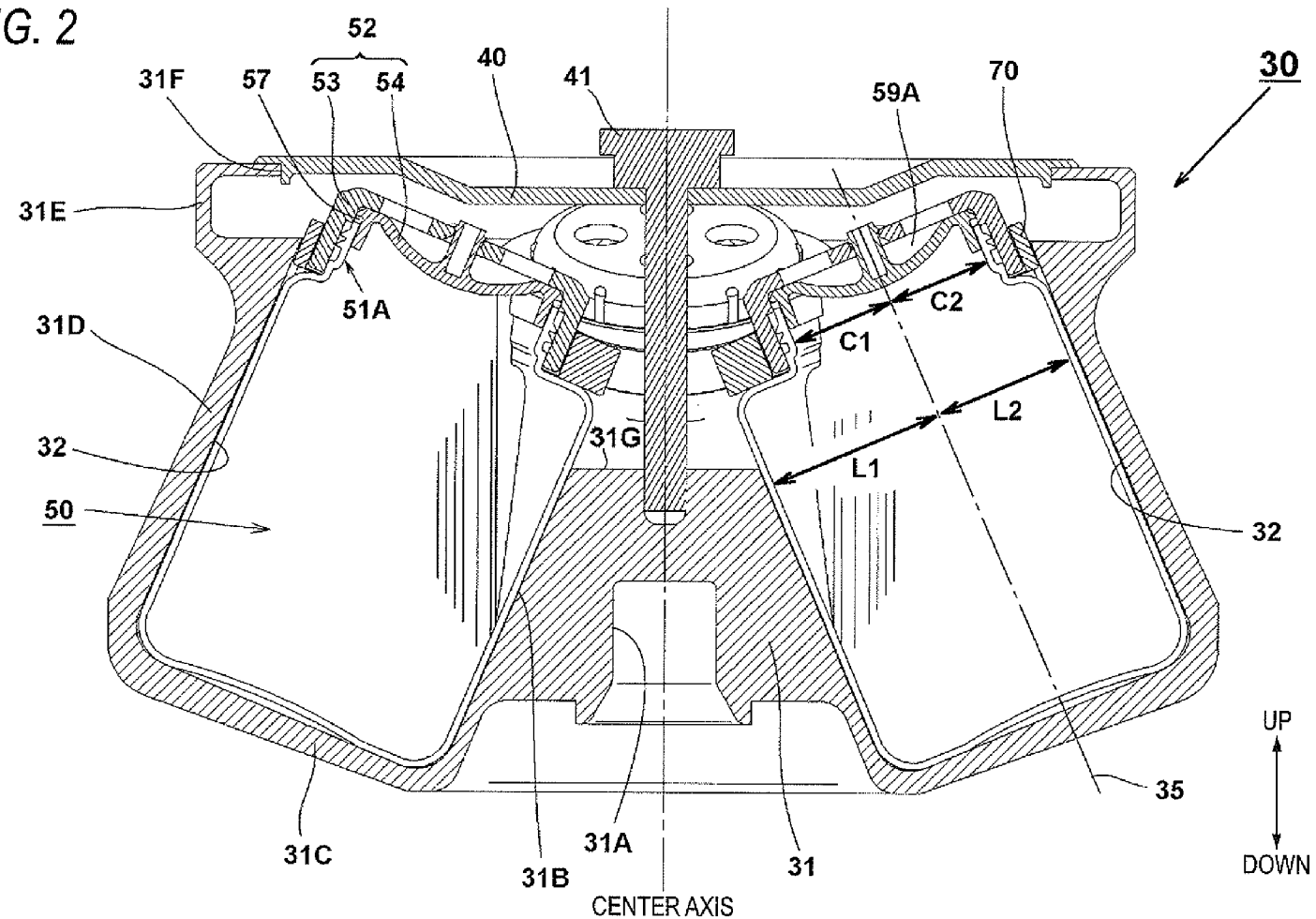
FIG. 2 is a longitudinal cross sectional view of a rotor 30 of the embodiment of the present invention.

The rotor and the specimen container of the present invention are now described by reference to FIGS. 2 and 3. FIG. 2 is a longitudinal cross sectional view of the rotor 30 shown in FIG. 1. A plurality of specimen container holding cavities 32 are formed at equal angular pitches in the rotor 30 along its circumferential direction. The specimen container 50 filled with a liquid specimen is inserted into each of the holding cavities 32. An annular liquid seal groove 31E for preventing leakage of a liquid from the rotor 30, which would otherwise arise when a specimen leaks from the specimen container 50 during centrifugal separation, is provided in an upper side of the rotor 30. An opening 31F is formed in an upper portion of the annular liquid seal groove 31E. The opening 31F is provided with a rotor cover 40, and the rotor cover 40 is screwed to the rotor body 31 by means of a handle 41, whereby the interior of the rotor 30 is sealed. A drive shaft hole 31A used for attaching the drive shaft 12 of the drive 5 is formed in a lower portion of the rotor body 31 in line with its center axis. What is important to the drive shaft hole 31A is to be secured so as to be relatively nonrotatable with respect to the drive shaft 12. The drive shaft hole 31A can be fastened by use of a known securing method in the field of the centrifugal separator. By means of the attachment method, the rotor 30 is rotationally driven at predetermined speed by the motor 7.

An opening 51A is provided in an upper portion of the specimen container 50, and the cap 52 is attached to the opening 51A. The cap 52 includes an outer cap 53 and an inner cap 54. The cap 52 is screwed, to thus seal the opening 51A. A characteristic of the present embodiment lies in that a distance L1 achieved perpendicularly from a vertical center line 35 of the specimen container 50 to an inner-circumference-side sidewall of the container is considerably larger than a distance L2 from the center line 35 to an outer-circumference-side sidewall of the container. In the meantime, in the opening 51A, a distance C1 from the center line 35 to an inside of the opening is equal to a distance C2 from the center line 35 to the outside of the opening. The distances L1, L2, C1, and C2 are assumed to be measured in the direction perpendicular to the center line 35. Further, the center line 35 is a line passing through a center position of the cap 52 or the opening 51A. The center line 35 is a virtual line passing through a center position (or a centroid) of a bottom surface of the specimen container 50 and a center position of the cap 52 (a position where a projection 54 to be described later is located). A vertical, positional relationship exists between the center line 35 and an upper surface of the outer cap 53.

Figure 3:
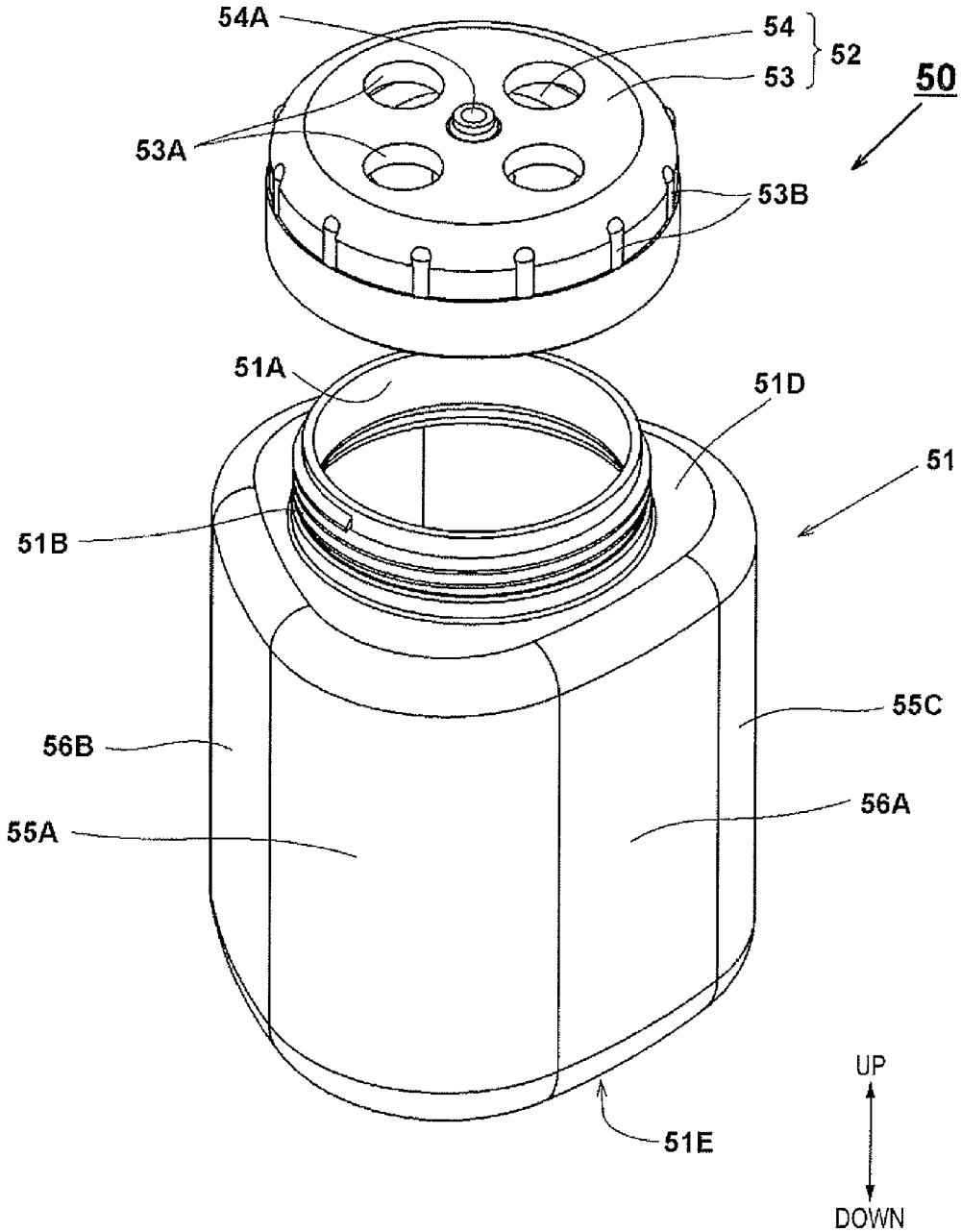
FIG. 3 is an oblique perspective view showing an external view of a specimen container 50 of the embodiment of the present invention.

FIG. 3 is an oblique perspective view showing an external view of the specimen container 50 with the cap 52 being removed. In FIG. 3, the specimen container 50 is divided into the body 51 and the cap 52. The body 51 is a container area for containing a liquid specimen subject to centrifugal separation, and the circular opening 51A serving as an in/out port for a specimen is provided in an upper portion of the body 51, and a male screw 51B is formed on an outer circumference side of the opening 51A. As represented by a cross section in FIG. 2, an O-ring 57 (see FIG. 2) for sealing the opening 51A of the specimen container 50 is attached to the inner cap 54, and the outer cap 53 is provided so as to cover the O-ring and the inner cap. A female screw 52B (which will be described later) to be fastened to the male screw 51B of the opening 51A of the body 51 is provided on an internal surface of the outer cap 53. A plurality of through holes 53A for ejection purpose that penetrate through a space made by a protuberance 54A of the inner cap 54 are made in an upper portion of the outer cap 53. Adoption of such a shape makes it possible to assure an inner cap space between the outer cap 53 and the inner cap 54. The space is made such that spacing with respect to the outer cap becomes greater with an increasing proximity to the center of the outer cap 53. Spacing between the outer cap 53 and the inner cap 54 is set to a depth of about 3 to 10 mm so that an adult can catch hold of the container with fingers. It is then possible to hold the through hole 53A with a thumb and a forefinger or additionally with a middle finger. Thus, the specimen container 50 inserted into the holding cavity 32 of the rotor body 31 can readily be withdrawn.

The through hole 53A may be of any shape and provided in any numbers, so long as the hole enables easy removal of the container. However, a desirable size for the through hole is a size of an adult's fingertip, especially, a size which enables insertion of a thumb. Namely, a diameter of about 20 mm is preferable. The through holes 53A are not always necessary. In the case of the rotor 30 of the present embodiment, it is possible to grip the outer circumference of the cap 52, to thus pull the specimen container 50 out of the rotor body 31. Hence, it may not be necessary to provide the specimen container with the through holes 53A. In order to make the worker easy to grip and turn the cap 52, projections 53B for preventing occurrence of slippage are provided at equal intervals on the outer circumference of the outer cap 53 in its circumferential direction.

The body 51 of the specimen container 50 is a container whose transverse cross sectional shape is based on an equilateral triangle. However, sides (sides 56A, 56B, and 56C, in which the side 56C will be described later) of the equilateral triangle are formed into curved surfaces having a large curvature radius such that the sides assume a gentle externally-bulging shape. Three vertices (vertices 55A, 55B, and 55C, in which the vertex 55B will be described later) of the equilateral triangle are connected together by means of curved surfaces having a small curvature radius. A shoulder 51D that is plane in a horizontal direction is formed so as to outwardly extend from the male screw 51B of the body 51. When viewed from above, a profile of an outer edge of the shoulder 51D assumes a substantially triangular shape (the shape of a triangle rice ball).

Figure 22:
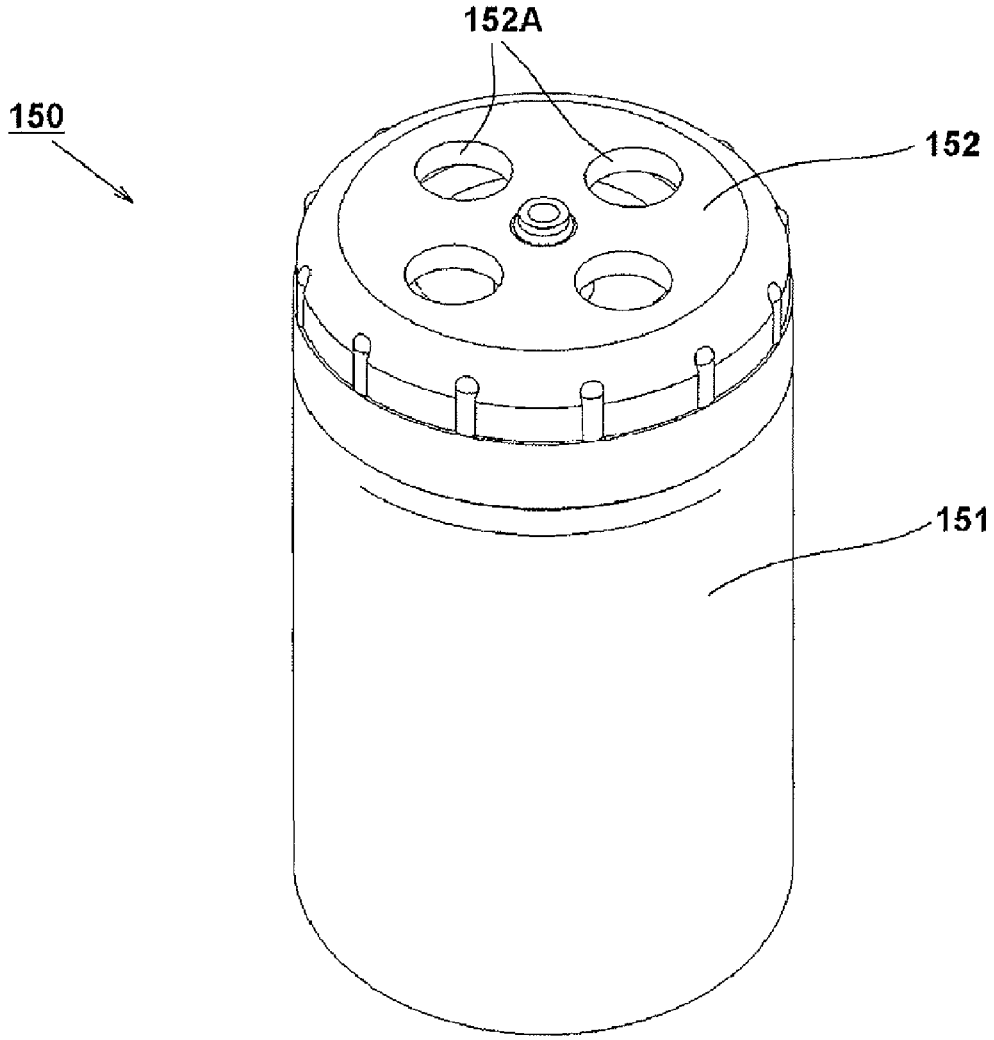
FIG. 22 Conventional Art
FIG. 22 is an oblique perspective view showing a shape of the related-art specimen container 150.

Areas that extend from the shoulder 51D to the sides 56A to 56C and to the vertices 55A to 55C are connected by means of gently-curved surfaces that have a small curvature radius when viewed in their longitudinal cross sections. These areas serve as a connection area extending from the shoulder to the sides and another connection area extending from the shoulder to the vertices. The areas are imparted with a shape having the minimum curvature radius in order to enhance the strength of the areas. Likewise, areas extending from a bottom surface 51 E to the sides 56A to 56C and to the vertices 55A to 55C are also connected by means of gently-curved surfaces having a small curvature radius when viewed in their longitudinal cross sections. From the oblique perspective view shown in FIG. 3, it can be understood that the non-cylindrical specimen container 50 of the present embodiment is greatly different from the related-art cylindrical specimen container 150 (FIG. 22). The cap 52 of the specimen container 50 may assume the same structure as that of the cap 152 of the related-art specimen container 150. Therefore, so long as the cap has the same diameter as that of the cap 152 of the related-art specimen container 150, the cap can be used, as it is, as the cap 52. When the same cap is used, the body 51 has become much bigger than the body 151 shown in FIG. 22. Hence, it can be seen that the amount of specimen that the container can contain is considerably increased.

It is preferable that the body 51 and the cap 52 of the specimen container 50 be manufactured from a material; namely, thermoplastics, such as polypropylene and polycarbonate. The body 51 can readily be manufactured by blow molding or injection blow molding. The cap 52 can be readily manufactured by injection molding. As a result of the body and the cap being formed from plastics, it becomes possible to realize a specimen container that exhibits superior chemical resistance and that is easy to handle. A rubber-made O-ring is suitable for the O-ring 57, and a commercially-produced O-ring is available. The color of the body 51 may be transparent or colored so as to make the inside of the specimen container obscure.

Figure 4:
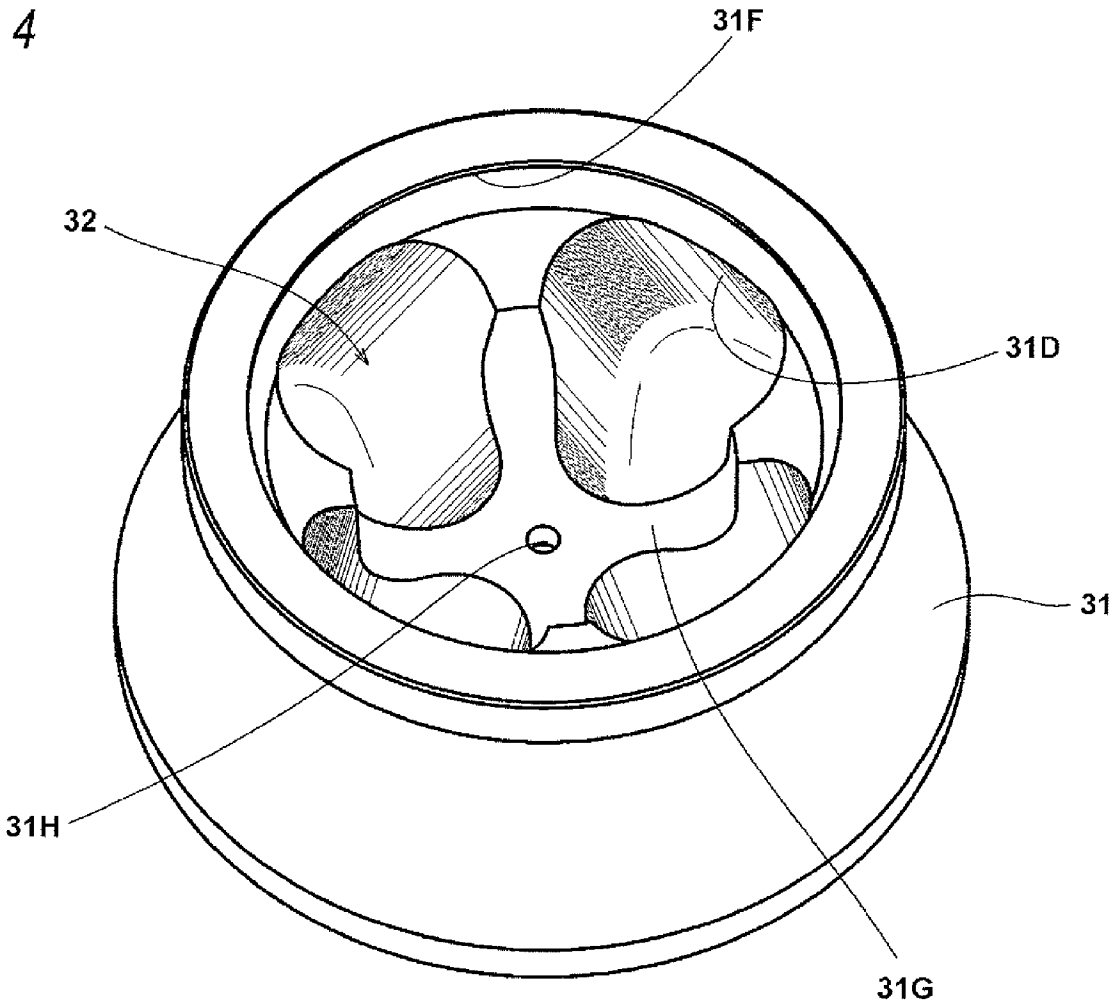
FIG. 4 is an oblique perspective view of a rotor body 31 of the embodiment of the present invention.
Figure 5:
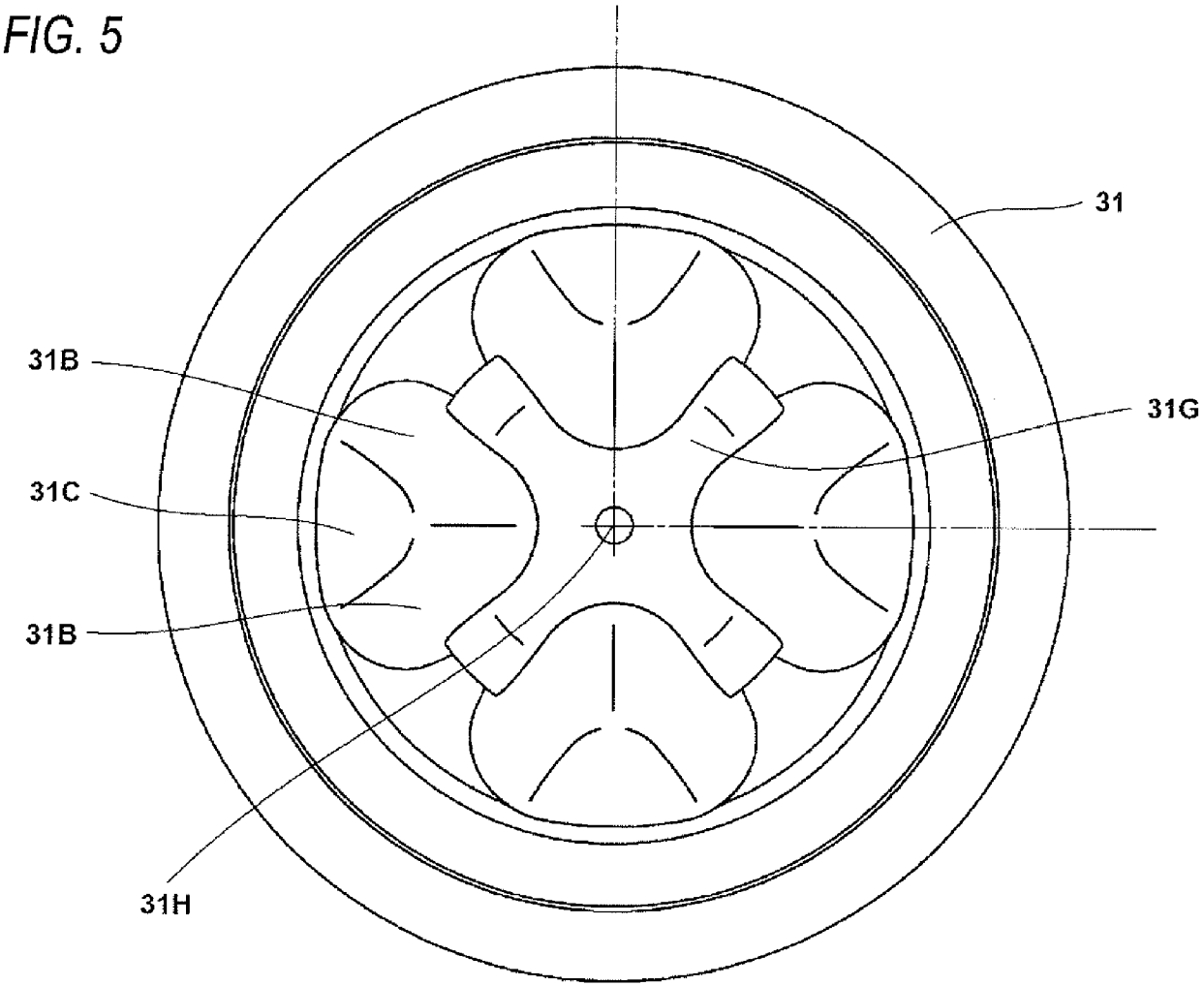
FIG. 5 is a top view of the rotor body 31 of the embodiment of the present invention.

The shape of the rotor body 31 is now described by reference to FIGS. 4 and 5. FIG. 4 is an oblique perspective view of the rotor body 31 of the embodiment of the present invention, and FIG. 5 is a top view of the rotor body 31. Four noncolumnar holding cavities 32 used for insertion of the specimen containers 50 are formed in the rotor body 31. The holding cavities 32 are substantially identical with an outer shape of the specimen container 50. In relation to a preferred size of the holding cavity 32, it is desirable that the holding cavity be embodied in the form of spacing which enables comfortable detachable attachment of the specimen container 50 and which is as small as possible. For instance, spacing between a wall surface of the holding cavity 32 and an external surface of the body 51 of the specimen container 50 is about 0.1 to 1 mm. If spacing is too large, a degree of deformation in the body 51 caused by fluid pressure or centrifugal force exerted on the specimen container 50 during centrifugal separation will become greater; hence, durability of the specimen container 50 can drop. The holding cavity 32 is principally formed from four surfaces; namely, a bottom 31C and two inner circumferential sidewalls 31B (that primarily two sides of the specimen container 50 contact) which are shown in FIG. 5, and an outer circumferential sidewall 31D shown in FIG. 4 (that primarily two sides of the specimen container 50 contact). The outer circumferential sidewall 31D is a curved surface having a large curvature radius commensurate with the specimen container 50, and the curvature radius of the curved surface is determined so as to become substantially parallel to a curvature of the outer circumference of the rotor body 31. So long as the rotor body is formed as mentioned above, an unwanted increase in the thickness of an area in the vicinity of the outer circumferential sidewall 31D, which would otherwise arise for reasons of a curvature difference, can be prevented, and an attempt can be made to reduce the weight of the rotor 30. As shown in FIG. 3, the holding cavity 32 is formed so as to cover substantially the entire surface and bottom of the body 51 exclusive of its inner-circumferential portion. It becomes possible to prevent deformation of the specimen container 50 itself during centrifugal separation, by maximizing the area to be covered.

The holding cavities 32 become larger by an amount corresponding to an increase in the capacity of the specimen containers 50, and surrounding areas of the holding cavities 32 are thinned, whereby a volume of a metal part is reduced. Therefore, the weight of the rotor body 31 can be lessened. Further, the rotor body 31 of the embodiment has a bored portion (thinned portion) 31G that is made by downwardly boring a center area of the rotor body. The reason for this is that centrifugal load exerted on the specimen container 50 in the vicinity of the bored portion acts in a direction of the outer circumference of the rotor (centrifugal load will be described later by reference to FIG. 12) and that holding of the specimen container toward the inner circumference of the rotor is not important. As a result of the bored portion (the thinned portion) 31G being made as mentioned above, a weight of an upper portion of the rotor body 31 located in line with its center axis can be reduced, so that it is possible to accomplish further weight reduction of the rotor 30. Further, making the bored portion (the thinned portion) 31G enables lowering of a centroid of the rotor 30. A screw hole 31H into which the handle 41 is screwed, to thus secure the rotor cover 40 is made in the center area of the rotor body 31.

The rotor body 31 is an integral construction (of a solid type) manufactured by machining through use of an aluminum alloy material or a titanium alloy material. The rotor body 31 can also be manufactured from CFRP composite material. During machining of a metallic material, a milling machine is used for boring the holding cavities 32, and an end mill is used as a cutting tool, whereby machining can be facilitated. Since an outer dimension of the rotor body 31 is limited by the size of the chamber 3 (see FIG. 1). Therefore, if the rotor body is made in the same size as that of the related-art rotor body, the rotor 30 of the embodiment can also be used in the related-art centrifugal separator.

Figure 6:
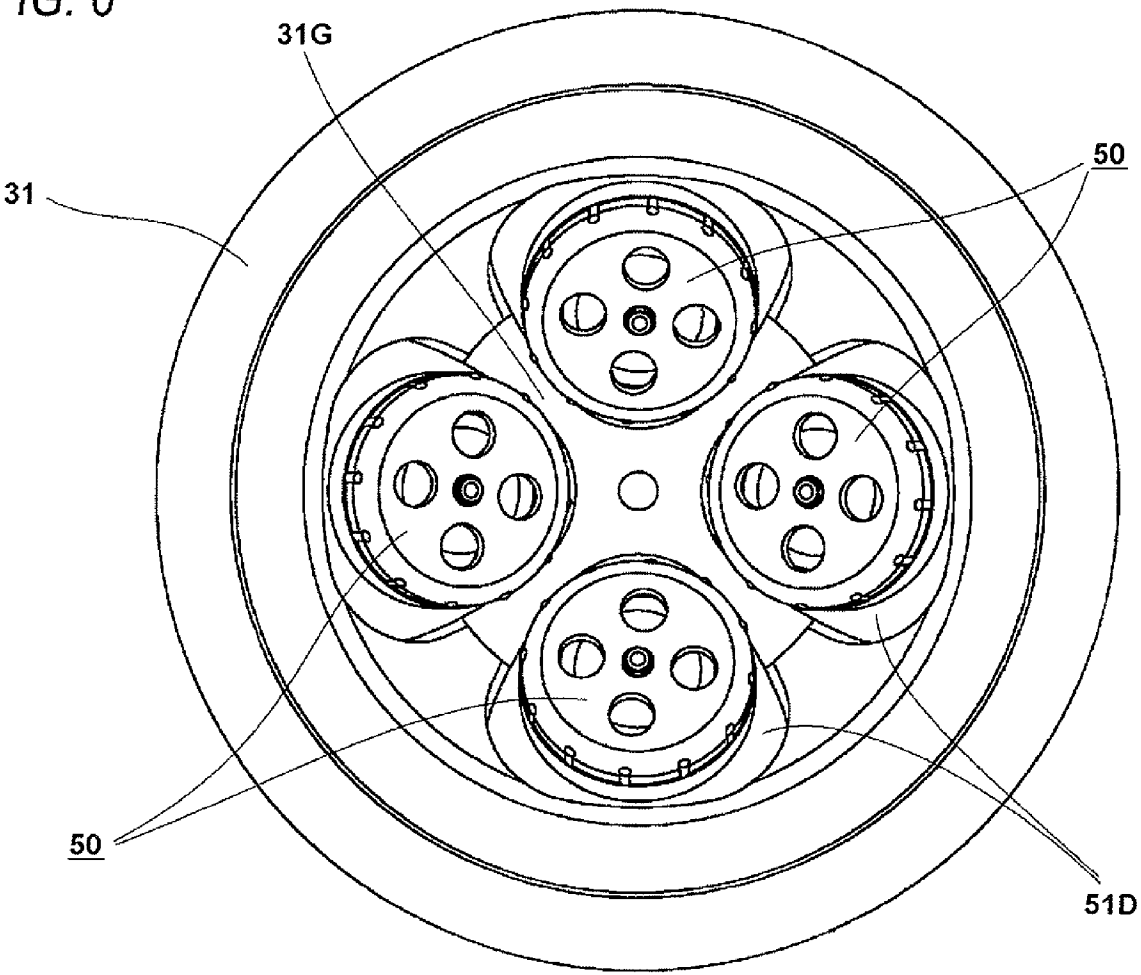
FIG. 6 is a top view of the rotor body 31 of the embodiment of the present invention equipped with the specimen container 50.

FIG. 6 is a top view showing that the rotor body 31 is equipped with the specimen containers 50. FIG. 6 shows a state in which the neck support member 70 to be described later is not attached to the rotor body 31 so as to make a reader well understand how the specimen containers 50 are placed. The rotor body 31 of the present embodiment belongs to a so-called angle rotor in which the bottom surface 31C of the holding cavity 32 is located at a predetermined angle so as to be spaced from the vertical center line (an axial line of the rotary shaft) of the rotor 30. A preferred angle is 20° or more and less than 25°. In the present embodiment, the angle is 23°. To this end, as shown in FIG. 6, the specimen container 50 is arranged such that an upper surface of the cap 52 of the container becomes oblique with respect to the rotary shaft. It can also be understood that, when the specimen containers 50 are inserted into the holding cavities 32, the shoulders 51D of the respective specimen containers 50 become exposed when viewed from above, so that the outer circumference sides of the respective caps 52 are not held on the outer circumferential sidewalls of the respective holding cavities 32.

Figure 7A:
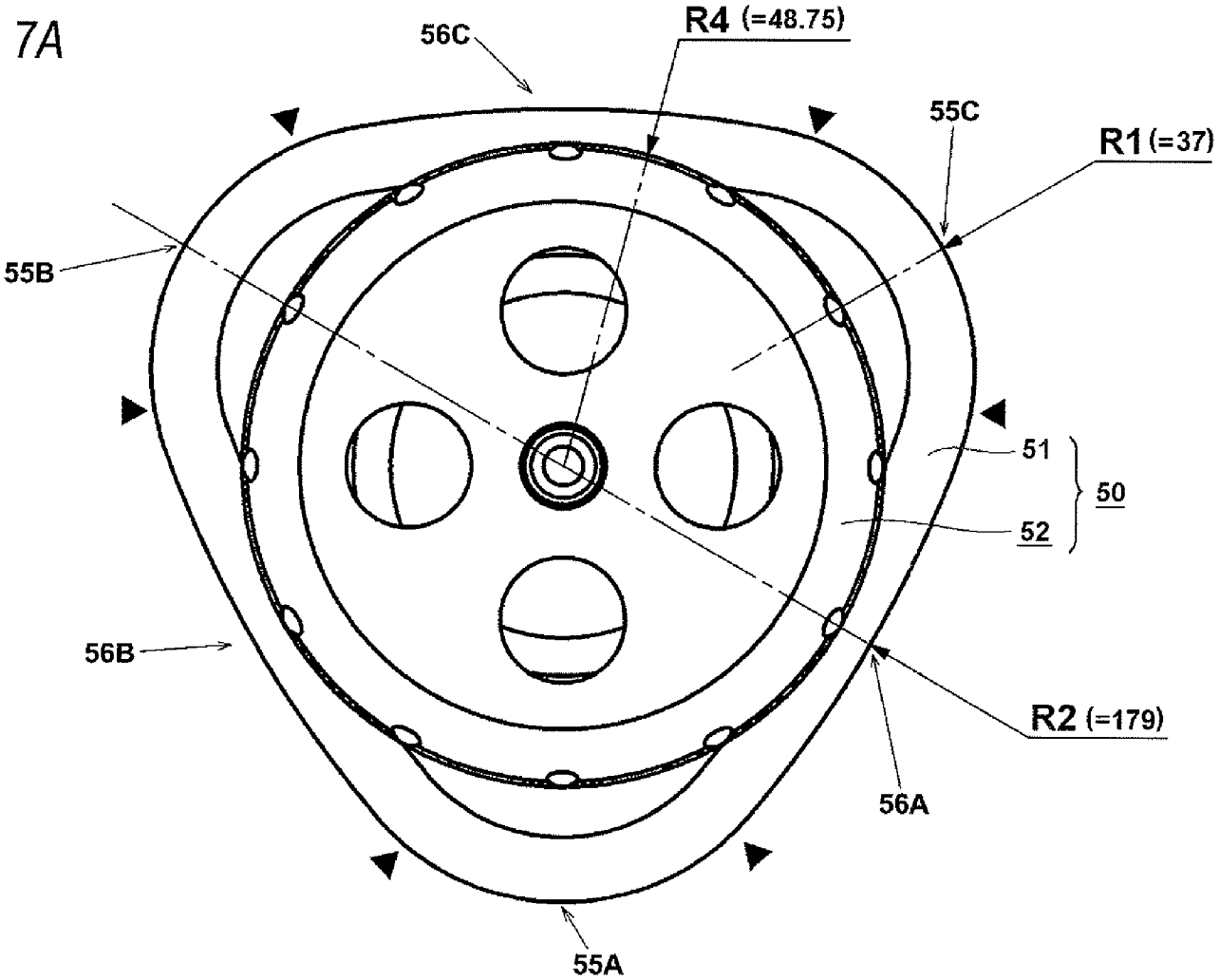
Figure 7B:
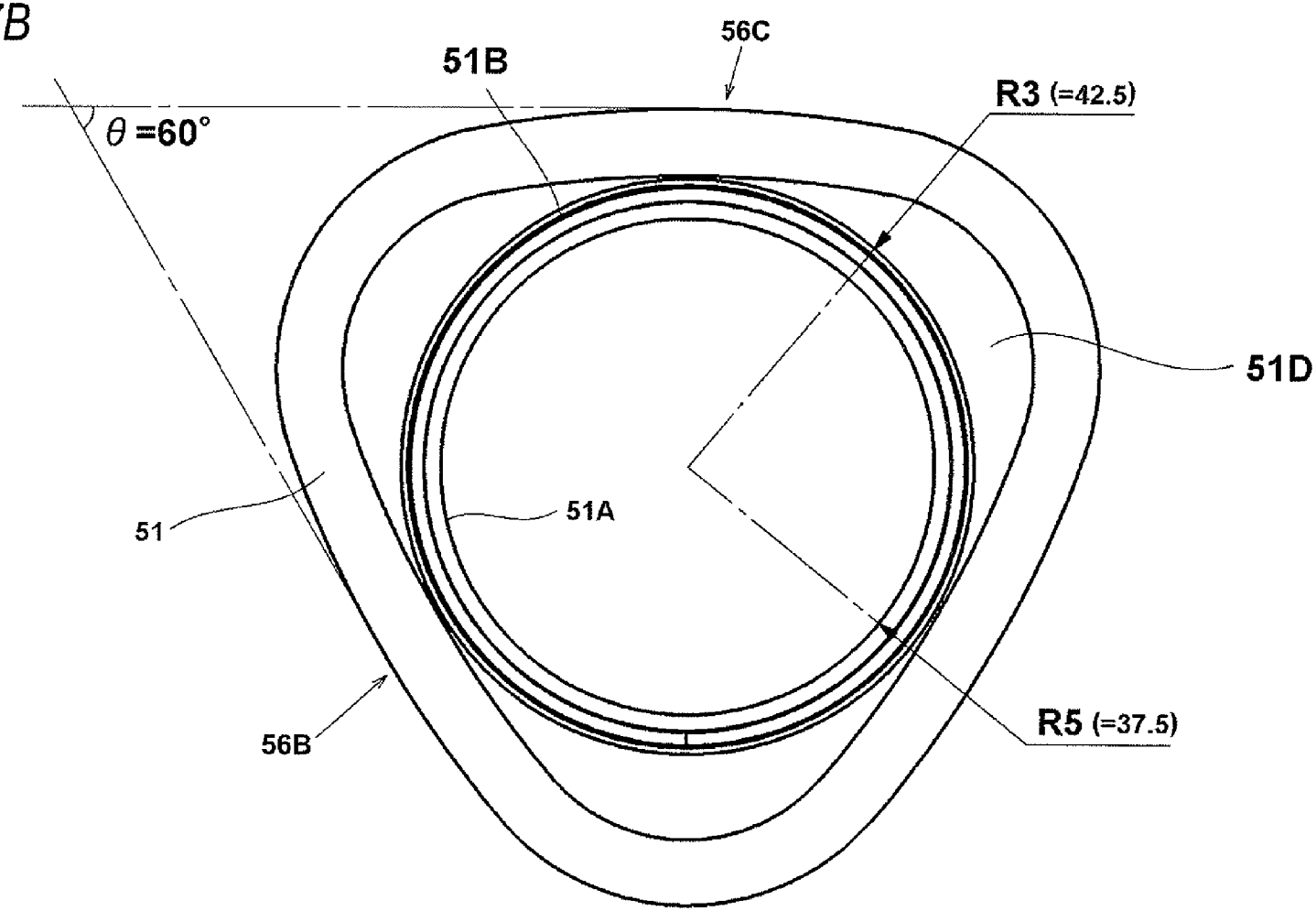

Dimensions of the specimen container 50 of the present invention are now described by reference to FIGS. 7A to 8. FIG. 7A-7B are top views of the specimen container 50, wherein FIG. 7A shows the specimen container equipped with the cap 52 and FIG. 7B shows the specimen container from which the cap 52 is removed. Numerals in parentheses in the drawings represent dimensions (in mm) of curvature radii. In FIGS. 7A and 7B, an outer shape of the body 51 of the specimen container 50 is based on a substantial equilateral triangle when viewed from above. A contour position of the body 51 is located outside a contour position of the cap 52, and the body 51 has the three vertices 55A, 55B, 55C and the three sides 56A, 56B, and 56C. The vertices 55A, 55B, and 55C are not pointed corners but each are given a shape formed as a result of connection of corners at a small curvature radius R1. Further, the sides 56A, 56B, and 56C are not straight when viewed from above and each assume a circular-arc shape that bulges at a large curvature radius R2 toward the outside of the specimen container 50.

When viewed from above, the specimen container 50 of the present embodiment includes the three curvature radii R1 and the three curvature radii R2. In the drawings, solid filled triangular marks denote locations where the curve having the curvature radius R1 and the curve having the curvature radius R2 are connected. As mentioned above, the three sides (the sides 56A, 56B, and 56C) of the body 51 of the specimen container 50 are formed from large circular-arc surfaces, and the three areas; namely, the vertices 55A, 55B, and 55C, are formed as small circular-arc surfaces. The specimen container is realized as a cylindrical container that assumes a substantially equilateral triangle when viewed from above or in its transverse cross section, whereby the capacity of the container can be significantly increased. Although the three sides (the sides 56A, 56B, and 56C) of the specimen container 50 can also assume a straight shape rather than a circular-arc shape, a slight increase in capacity can be accomplished by forming the three sides from outwardly-bulging, circular-arc surfaces. Further, the sides also exhibit an advantage, in terms of strength, against internal pressure exerted by a specimen in the container during operation of centrifugal separation.

In FIG. 7B, an intersection angle θ between extensions of tangential lines of the sides 56B and 56C that form one vertex is 60°. Although the drawings do not show tangential lines of the sides 56A and 56B and tangential lines of the sides 56C and 56A, the outer shape of the body 51 is a substantially equilateral triangle. Therefore, all intersection angles θ between the tangential lines are 60°. Further, equidistance exists between centers of the respective vertices 55A, 55B, and 55C (positions designated by arrows in FIG. 7A and corresponding to center positions between the solid filled triangular marks). The opening 51A formed in an upper portion of the body 51 has a radius R5, and the male screw 51B is formed on the outer circumference side of the opening 51A. An outer-circumference-side radius of the male screw 51B is R3. As mentioned above, since the opening 51A that is sufficiently smaller than the outer shape of the body 51 is formed in the body 51, there is formed the shoulder 51D that extends from the opening 51A to the sides 56A to 56C and to the vertices 55A to 55C. When the specimen container 50 is placed upright, the shoulder 51D acts as a horizontal surface. As a result of formation of the shoulder 51D, the strength of the body 51 can be further enhanced. Moreover, as a result of provision of the shoulder 51D, it becomes easy to attach the neck support member 70, which will be described later, to the specimen container.

Figure 8:
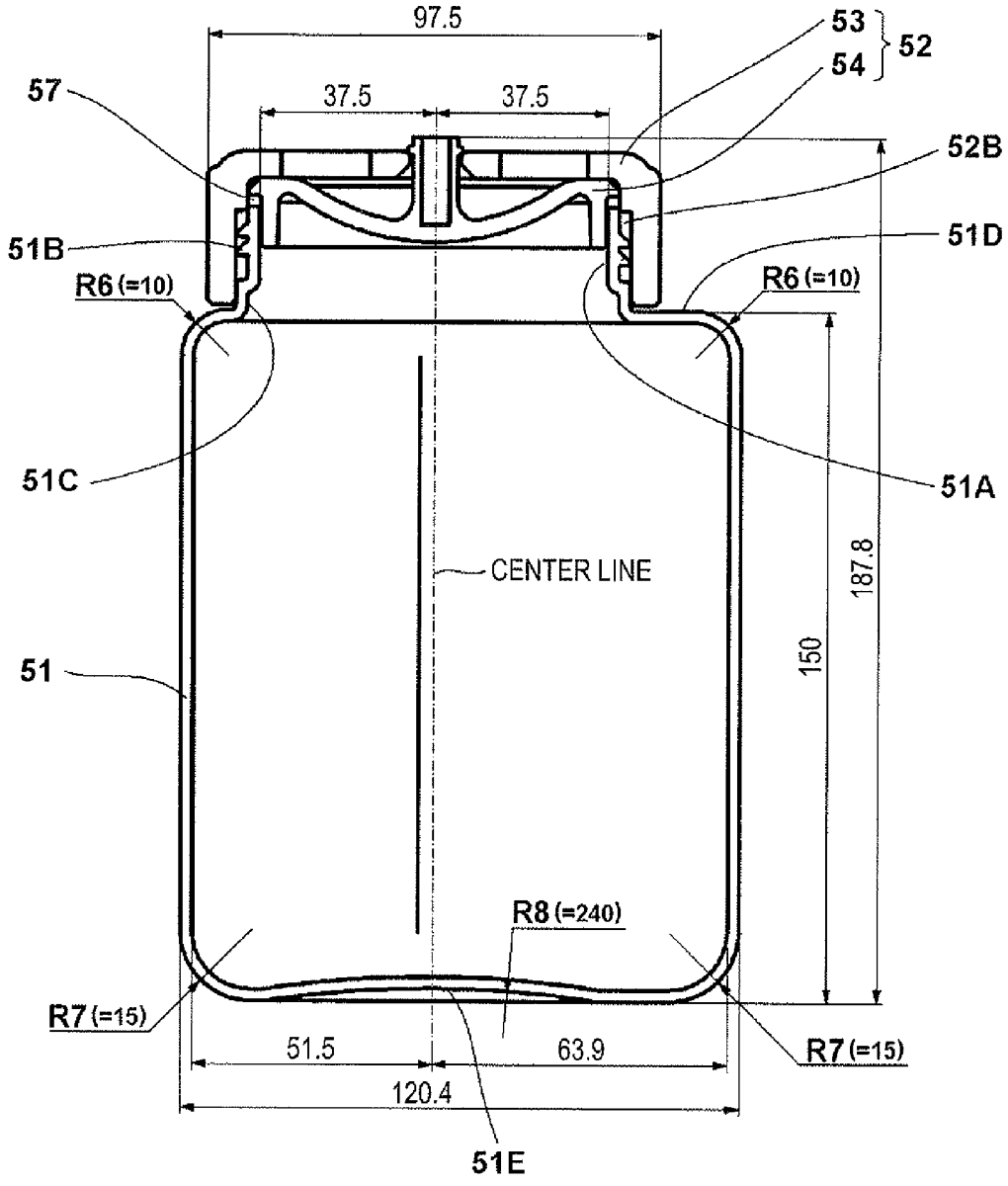
FIG. 8 is a longitudinal cross sectional view of the specimen container 50 of the embodiment of the present invention.

FIG. 8 is a longitudinal cross sectional view of the specimen container 50 of the present embodiment including dimensions of respective portions (in mm). An area at a junction of a vertical portion of the body 51 and the shoulder 51D is made in the form of a gentle curve having a curvature radius R6. Further, an area at a junction of the bottom surface 51E, which is a lower portion of the body, and the vertical portion of the body 51 is made in the form of a gentle curve having a curvature radius R7. A center area of the bottom surface 51E assumes a slightly-upwardly-raised shape, and a curvature radius R8 of the raised area is set to a value of about 240 mm. When the specimen container 50 is placed upright on a table, or the like, (i.e., in a state shown in FIG. 8), a contact area between an underside of the bottom surface and the table becomes smaller, so long as the specimen container is constructed as mentioned above. Consequently, when placed, the specimen container 50 becomes stable. In the embodiment, the shape of a floor is substantially triangular. However, this does not mean that an area contacting the floor surface is triangular but that an upper portion of the floor; namely, the shape of an inner surface side of the body, is triangular.

In relation to dimensions of the commercialized columnar specimen container 50 (see FIG. 22), the body 151 has an outer diameter (diameter) of 98 mm; a body length of 133 mm; and a specimen capacity of 900 ml. Only the R2 dimension of the specimen container 50 of the embodiment is changed so as to circumscribe the outer diameter of the related-art columnar specimen container 150. In terms of a container height, an opening diameter, the outer cap, and the inner cap, the specimen container 50 is made identical with the specimen container 150. In this case, an interior content of the specimen container 50 comes to 1075 ml, so that a capacity of specimen that can be contained can be increased by 19.5%. By virtue of an increase in capacity resultant from a substantially-triangular shape and adoption of the R2 dimension and the container height, such as those shown in FIG. 8, a target capacity of 1200 ml that is greater than a related-art nominal capacity of 1000 ml by 20% can be significantly surpassed. In the embodiment, it has become possible to accomplish a capacity of about 1500 ml.

Figure 9A:
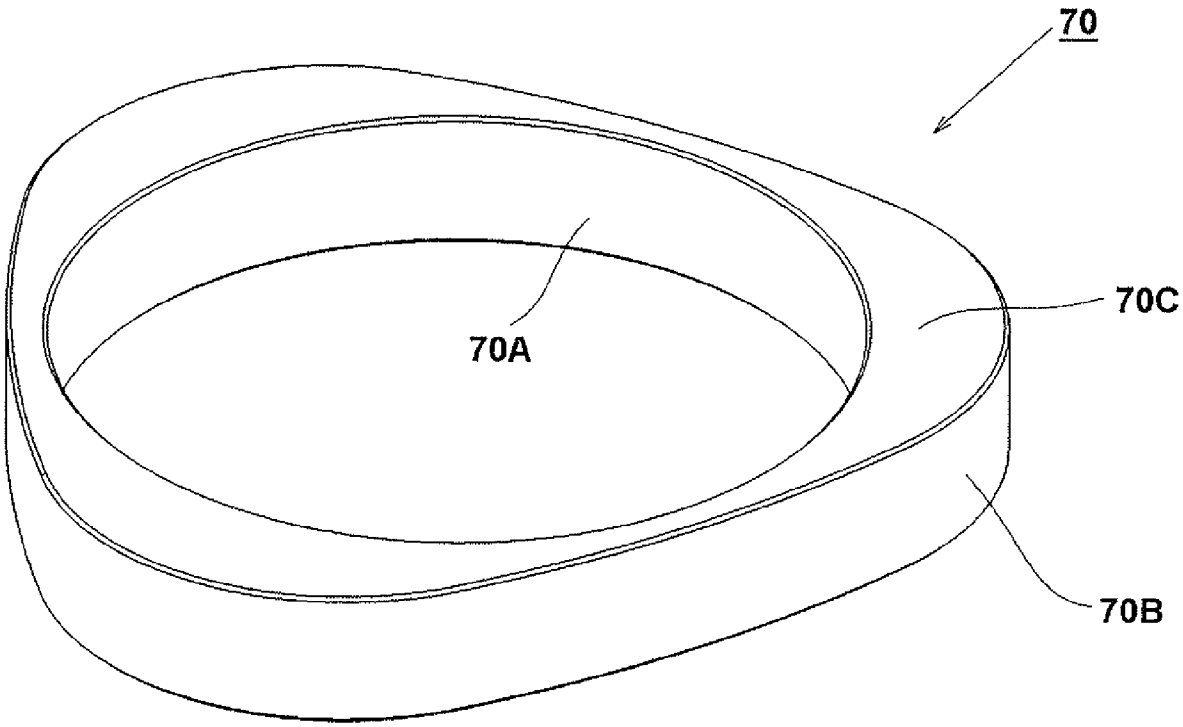
Figure 9B:
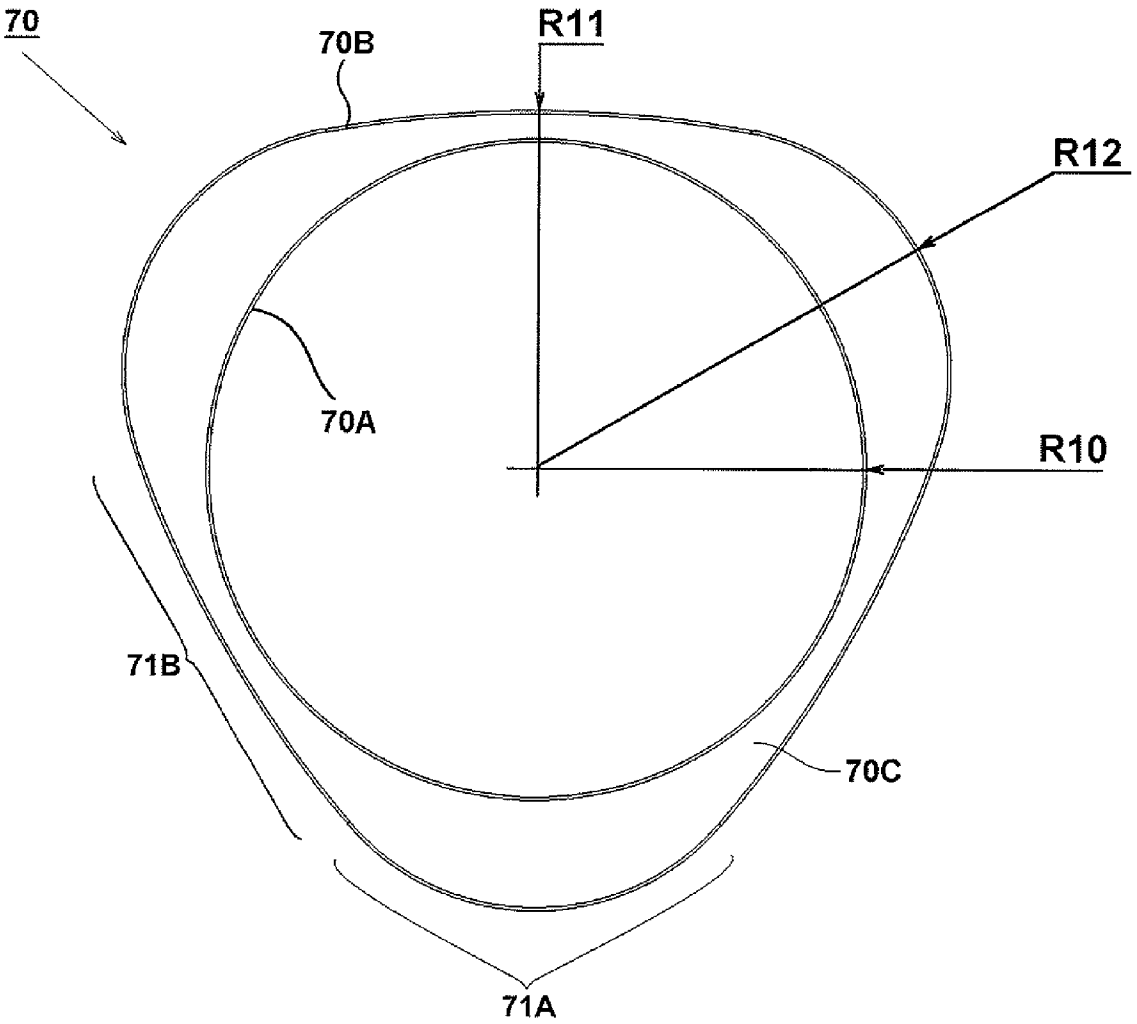

The neck support member 70 is now described by reference to FIGS. 9A and 9B. FIGS. 9A and 9B are views showing a shape of the neck support member 70 shown in FIG. 2. FIG. 9A is an oblique perspective view, and FIG. 9B is a top view. As shown in FIG. 1, the neck support member 70 is to be interposed between the cap 52 of the specimen container 50 and the holding cavity 32 and acts so as to prevent deformation of the cap 52 of the specimen container 50 in a direction of centrifugal force.

Figure 21:
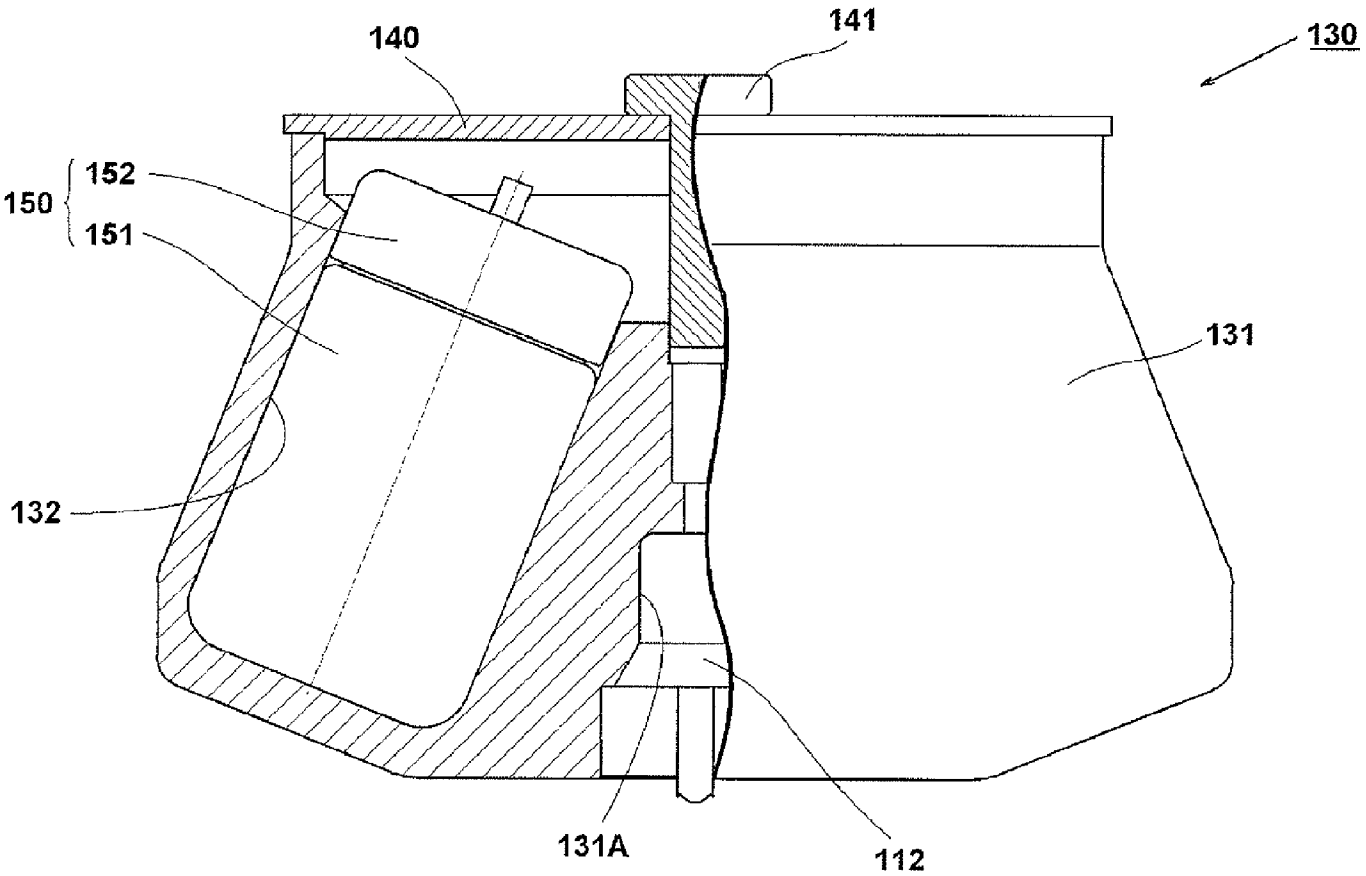
FIG. 21 Conventional Art
FIG. 21 is a side view of a related-art angle rotor 130 including its left half cross section.

In the centrifugal separator 1, the rotor 30 rotates at high speed. In the centrifugal separator 1 of the embodiment, a distance exists between the outer circumference portion of the cap 52 and the outer circumferential sidewall 31D of the rotor body 31, and there is not any element that holds the outer circumference side of the cap 52. Therefore, a damage can arise in an area around the opening 51A of the container 51; namely, the shoulder 51D, for reasons of centrifugal load of the cap 52. In the case of the related-art cylindrical specimen container 150 shown in FIG. 21, the body 151 and the cap 152 are identical with each other in terms of an outer shape, and hence the wall surface of the holding cavity 132 can hold the outer circumference side of the cap 152, so that such a phenomenon cannot arise. For these reasons, in the present embodiment, the neck support member 70 that acts so as to fill spacing between the cap 52 and the holding cavity 32 is provided in order to support the outer circumference portion of the cap 52.

The neck support member 72 is given a shape such that an outer shape of the support member is fitted to the holding cavity 32 of the rotor body 31 and that spacing between the support member and the holding cavity 32 comes to 0.1 to 1 mm, or thereabouts. A cap insertion hole 70A that is larger than the outer diameter of the cap 52 of the specimen container 50 by 0.1 to 1 mm, or thereabouts, is formed on an inside of the neck support member 70. A sufficient thickness for the neck support member 72 is a thickness sufficient to support the cap 52. The neck support member is not always required to have the same thickness as that of the cap. In the present embodiment, the thickness of the neck support member 70 is set to about 50% the height (thickness) of the cap 52 in consideration of strength of the cap 52.

A method for using the neck support member 70 includes inserting the specimen container 50 in the rotor body 31 and subsequently placing the neck support member 70 on the shoulder 51D from above so as to surround the cap 52. The essential requirement is to place the neck support member 70 on the specimen container 50. Use of the neck support member 70 makes it possible to prevent deformation of the cap 52 in a direction of centrifugal force during centrifugal separation. In relation to a material of the neck support member 70, the neck support member 70 can be produced from thermoplastics, such as polypropylene and polycarbonate, as in the case of the material of the container 51. The neck support member 70 can be readily manufactured by injection molding. What is important to the neck support member 70 is to make the neck support member from an inelastic material.

The original objective of the neck support member 70 can be intrinsically accomplished by merely holding substantially one-half (an exterior side of) the outer circumference of the cap 52. In the present embodiment, however, the neck support member 70 is given substantially the same shape as that of the specimen container 50 because of ease of manufacture, to thus assume vertices 71A and sides 71B, as shown in FIG. 9B. By virtue of the structure, the neck support member 70 can be inserted into the holding cavity 32 of the rotor body 31 at three positions in the circumferential direction of the rotor. Hence, attachment of the neck support members becomes easy. The shape of the neck support member 70 does not need to stick to the shape shown in FIGS. 9A and 9B and is liable to various modifications.

Figure 10:
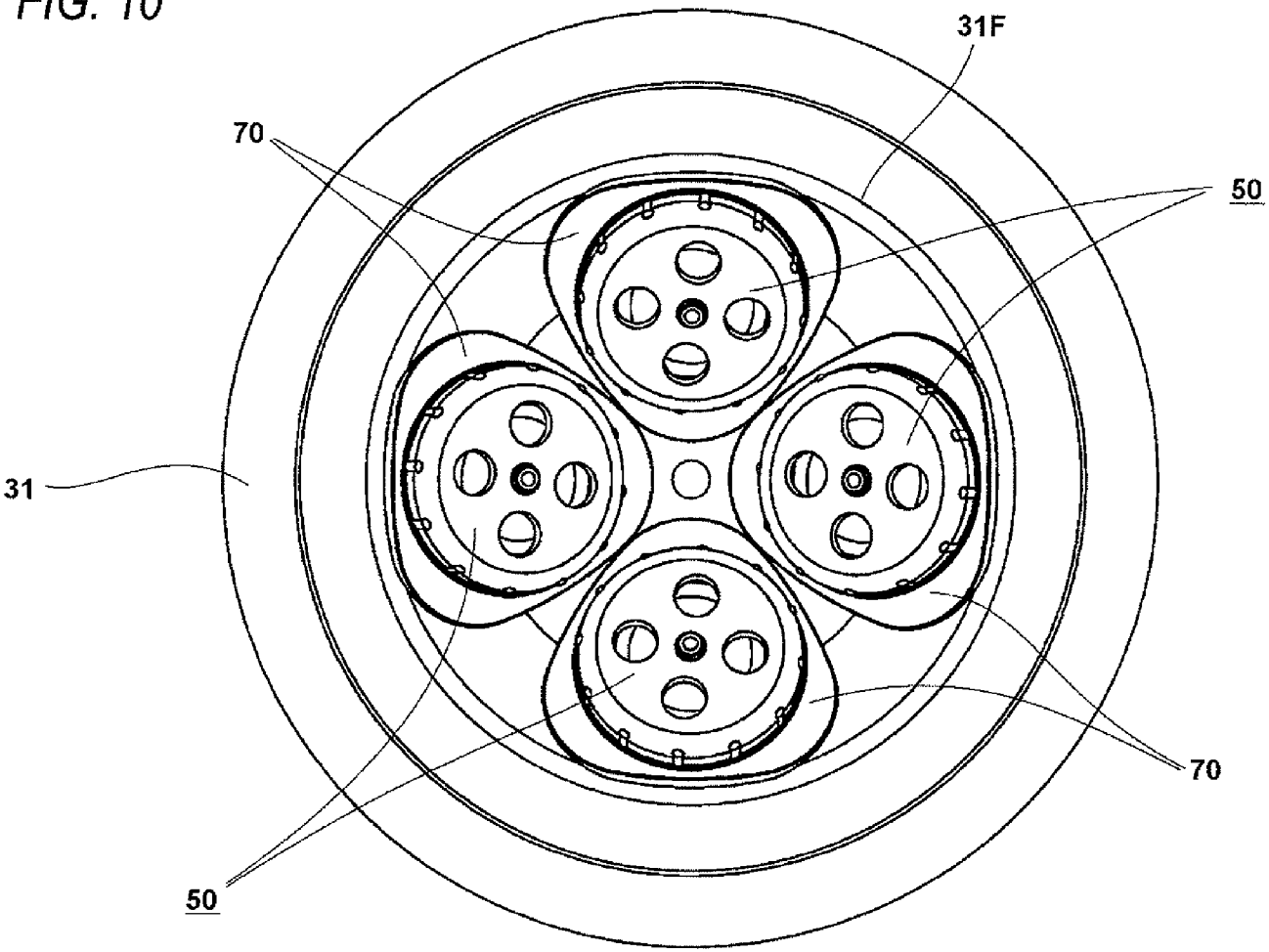
FIG. 10 is a top view showing that the rotor body 31 of the embodiment of the present invention is equipped with the specimen container 50 and the neck support member 70.

FIG. 10 is a top view showing that the specimen containers 50 and the neck support members 70 are attached to the rotor body 31. Since a predetermined angle is made in each of the holding cavities 32 of the rotor body 31, the specimen containers 50 and the neck support members 70 are attached to the rotor body not at right angles to the rotor body 31 but at an inclination equivalent to the angle. As mentioned above, after the neck support members 70 have been attached, the rotor cover 40 is put on the rotor body, and centrifugal separation is commenced.

As mentioned above, in the present embodiment, the transverse cross sectional shape of the specimen container 50 is made non-circular, to thus increase the capacity of the specimen container. Therefore, the weight of the rotor 30 equipped with the specimen containers 50 is increased. However, an increase in amounts of specimens and a decrease in the volume of the rotor are subjected to mass conversion. In relation to the rotor body 31 of the present invention, the pads around the respective specimen container holding cavities can be reduced while the amounts of the specimens are increased. Moreover, an increase in the amounts of the specimens can be housed in the space for the pads. Therefore, as compared to the related-art-type rotor 131 having the same outer diameter, the rotor 30 can prevent both an increase in the diameter of the rotor and an increase in a mass of the rotor.

Figure 11:
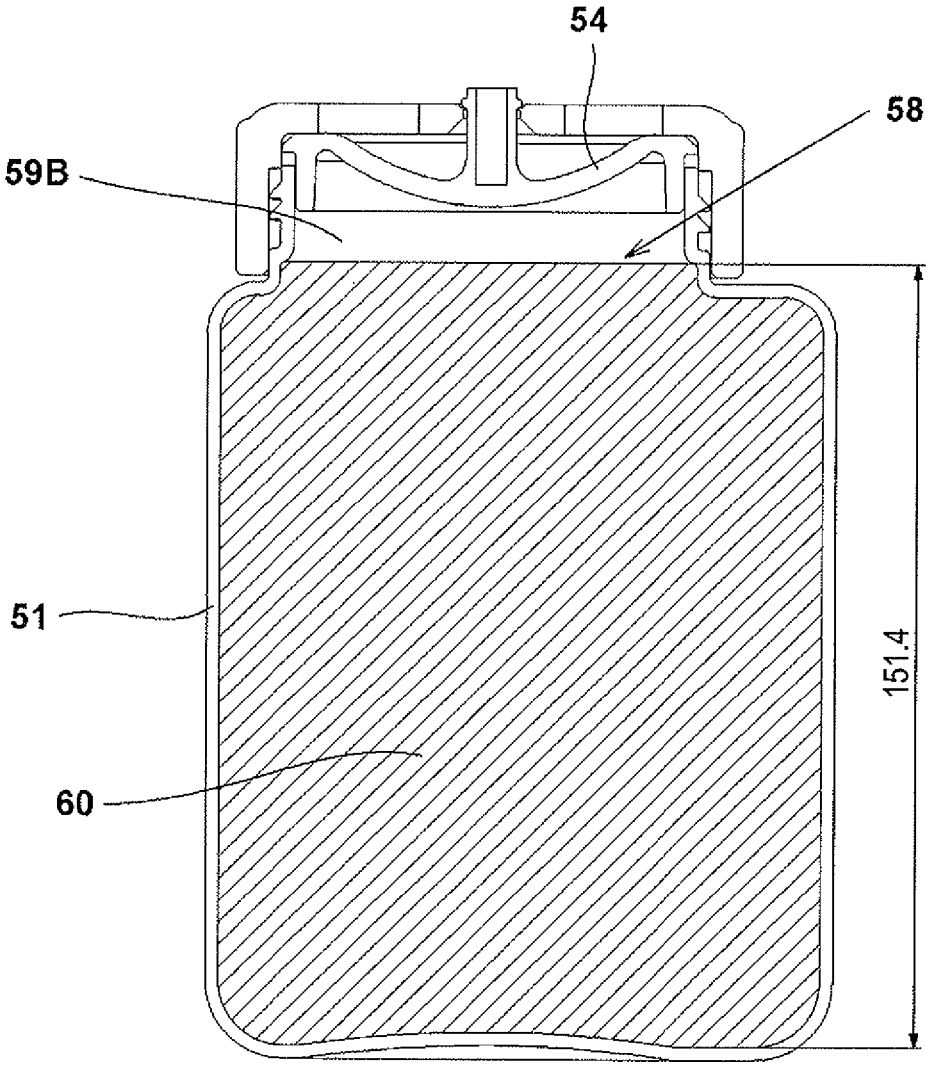
FIG. 11 is a longitudinal cross sectional view of the specimen container 50 of the embodiment of the present invention containing the maximum amount of specimen.
Figure 12:
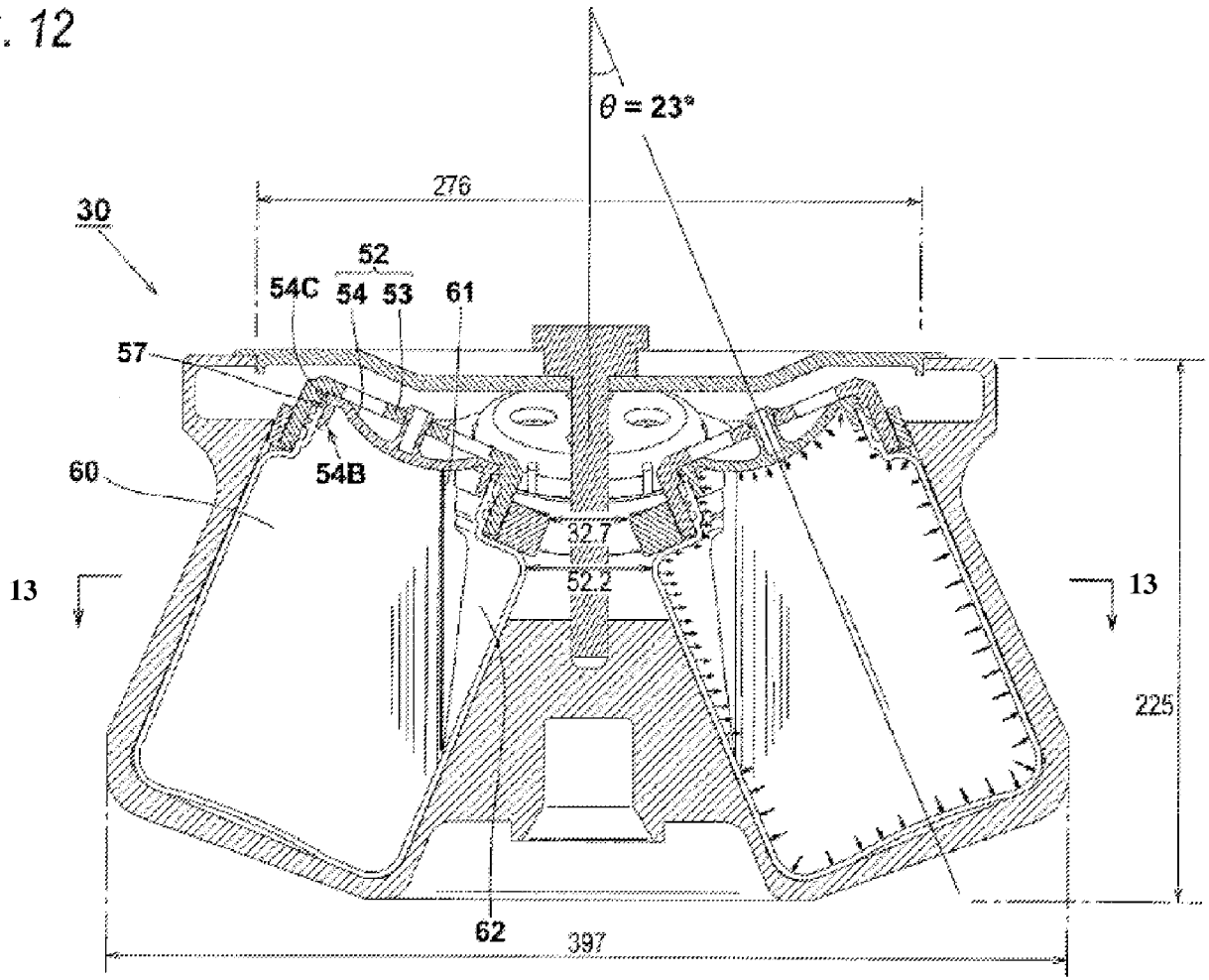
FIG. 12 is a longitudinal cross-sectional view of the rotor 30 of the embodiment of the present invention.

A state of centrifugal separation performed by the centrifugal separator 1 of the present embodiment is now described by reference to FIGS. 11 to 15. FIG. 11 shows a state in which a specimen 60 is put in the specimen container 50 up to an upper limit position 58. When the specimen 60 is loaded into the specimen container 50 of the present embodiment up to the upper limit position 58, a capacity of 1500 ml is achieved. Even when the specimen container is filled with the specimen up to the upper limit position 58, a space 59B exists between the inner cap 54 and the upper limit position 58, and air exists in the space. A cross sectional view of FIG. 12 shows operation of centrifugal separation performed in this state. FIG. 12 also includes dimensions (in mm) of the respective portions of the rotor 30 that accommodates a capacity of 1500 ml. A diameter of the rotor body 31 is preferably between 350 mm and 450 mm. In the present embodiment, the diameter of the largest thickness portion is 397 mm. A height of the rotor body 31 is preferably between 200 mm and 250 mm. In the present embodiment, the height of the rotor body is 225 mm. A diameter of the opening of the rotor body 31 is 276 mm. The angle θ of the specimen container 50 is 23°. A distance between the innermost circumferences of the mutually-opposing specimen containers 50 is 52.2 mm, and a distance between the innermost circumferences of the mutually-opposing neck support members 70 is 32.7 mm. The rotor 30 having this size is limited by the size of the chamber 3 to be accommodated (see FIG. 1). In the present embodiment, an inner diameter of the chamber 3 is 430 mm, and the inner largest height of the chamber is 276 mm.

During rotation of the rotor 30, the specimen 60 moves toward the outer circumference side by means of centrifugal force, as shown in FIG. 12. A longitudinal cross sectional view of the rotor 30 shown in FIG. 12 shows a state of the rotor 30 rotating at a target number of revolutions. A liquid level 61 of the specimen 60 is vertically oriented by means of centrifugal force. Moreover, the air in the specimen container 50 moves, as a result of which a space 62 where the thus-moved air is present is generated on an inner circumference side of the liquid level 61. When centrifugal load is exerted on the specimen 60, pressure caused by the centrifugal load, such as that indicated by a plurality of arrows provided on a right side of FIG. 12, exerts on respective portions of the specimen container 51 under fluid pressure. A skirt 54B of the inner cap 54 becomes deformed toward the outer circumference under the pressure and centrifugal load of the skirt itself, so that the skirt can be brought into close contact with an inner surface of the opening 51A of the body 51. Further, a flange 54C formed in a portion of the inner cap 54 and the outer cap 53 become deformed, by the centrifugal load exerted on them, so as to press the O-ring 57 against the body 51. Since the O-ring 57 comes into close contact with the inner cap 54 and the opening 51A of the specimen container, so that the specimen 60 does not leak outside from the cap 52.

Force for extruding a liquid to the outside of the container acts on the outer circumference side of the specimen container 50. Load in a direction in which the wall of the specimen container 50 is pushed outside by centrifugal force is exerted on the wall in the space 62. In ordinary cases, when the centrifugal load exerted on the wall of the specimen container 50 becomes greater, the specimen container 50 will be broken at worst. However, in the present embodiment, the portion of the specimen container 50 subject to the load comes to a neighborhood of the vertex on the inner circumference side. The vertex is made by the small curvature radius R1, exhibits high rigidity, and has no edge. Therefore, the vertex is also free from stress concentration and is highly resistive to centrifugal load. Moreover, the opening 51A of the specimen container 50 is circular, and the opening is inwardly drawn to enable attachment of the cap 52, thereby forming the shoulder 51D. Consequently, in the specimen container 50 of the present embodiment, the position of the air 62 that is an area particularly subject to load exhibits enhanced rigidity. Hence, the strength of the specimen container can be increased while the capacity of the specimen container is increased. As a result, it becomes possible to implement the specimen container 50 exhibiting superior durability.

Figure 13:
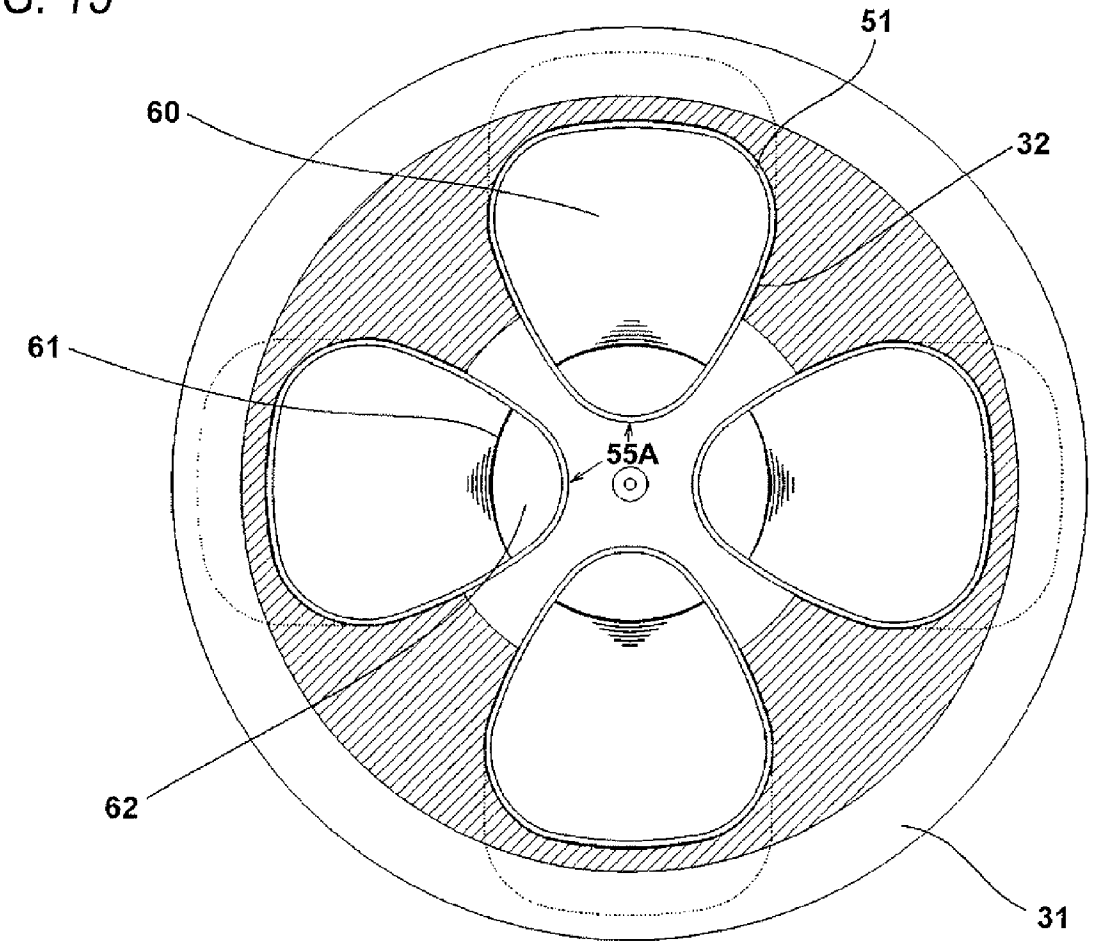
FIG. 13 is a cross sectional view of the rotor taken along line 13-13 shown in FIG. 12.

FIG. 13 is a cross sectional view taken along line 13-13 shown in FIG. 12. As can be understood by reference to FIG. 13, the liquid level 61 comes to a location in the drawing, and the space 62 is generated on the inner circumference side of the liquid level. Accordingly, the vertex 55A located in the space 62 in the body 51 of the specimen container 50 is not subjected to force that stems from liquid pressure caused by centrifugal force and that will act so as to inflate the vertex 55A. Therefore, force (load) that deforms the vertex 55A toward the inside of the body 51 is exerted on the vertex 55A. Therefore, be vertex 55A located in the space 62 withstands the centrifugal load by means of only the rigidity of the vertex itself. Even when viewed in transverse cross section of the vertex, the curvature radius of the vertex is smaller than the curvature radius of the related-art cylindrical specimen container 150. Hence, the strength of the vertex is especially great. Moreover, as a result of the vertex 55 being formed at the curvature radius R1 (in the form of a semi-circle), an edge disappears, so that stress concentration is also prevented.

Figure 14:
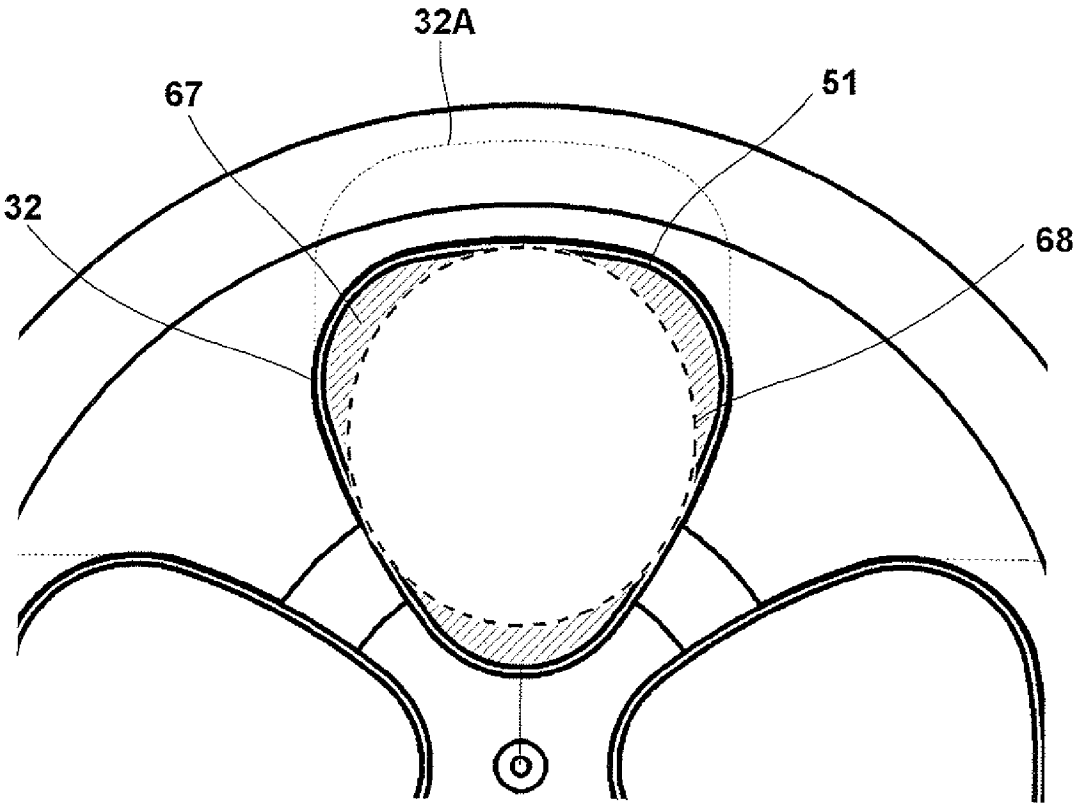
FIG. 14 is a view for comparing, in terms of a positional relationship, a shape of a body 51 of the specimen container 50 of the embodiment with a shape 698 of a body 151 of a relate-art cylindrical specimen container 150.

FIG. 14 is a view for making a comparison, in connection with a positional relationship, between the shape of the body 51 of the specimen container 50 of the embodiment with a shape 68 of the body 151 of the related-art cylindrical specimen container 150. A thin dotted line 32 denotes an outer contour of a bottom of the holding cavity 32. The shape 68 is denoted by a dotted line having wide spacing. A cross sectional shape of the body 51 of the embodiment (that is a cross section taken along line 13-13 shown in FIG. 12 and hence corresponds to a cross section perpendicular to a rotary shaft of the rotor 30 rather than a cross section perpendicular to the center line 35 (see FIG. 2) of the specimen container 50) is substantially triangular. The oval shape 68 denoted by the dotted line corresponds to a shape of the related-art cylindrical specimen container. A hatched area between the shape 68 of the related-art body 151 and the specimen container 50 of the present invention is equivalent to an increase in the amount of specimen. If this area is metal, the area will correspond to a pad space 67. The pad space 67 also represents an area equal to a decrease in the mass of the holding cavity 32 of the rotor body 31. The specimen container 50 and the holding cavity 32 are imparted with a substantially triangular shape, whereby the pad space 67, which has hitherto acted as pads to increase the mass of the rotor itself and centrifugal load exerted on the rotor itself at the time of utilization of the related-art columnar specimen container 150, can be eliminated. As a consequence, the capacity of specimen processed can be increased without involvement of an increase in the diameter of the rotor 31, whilst the mass of the rotor 30 can be curtailed.

Figure 15:
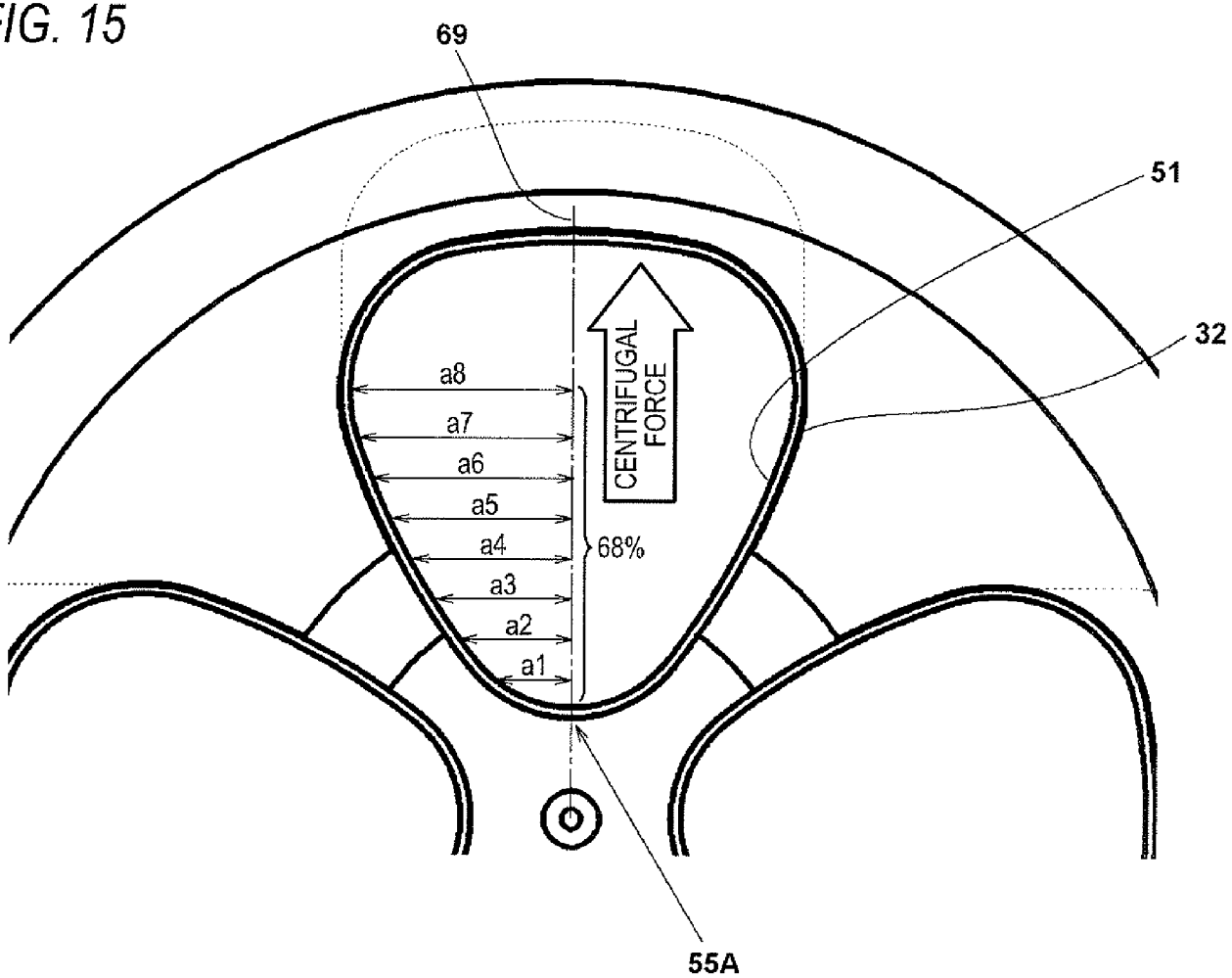
FIG. 15 is a view showing a relationship between a horizontal cross sectional shape of a holding cavity 32 shown in the cross section along line 13-13 shown in FIG. 12 and a direction in which centrifugal force is exerted.

By reference to FIG. 15, an explanation is given to a relationship between a horizontal cross-sectional profile (the cross section taken along line 13-13 shown in FIG. 12) of the holding cavity 32 and a direction in which centrifugal force is exerted. There is drawn a virtual line 69 passing through a center of the vertex 55A on the inner circumference side of the body 51 housed in the holding cavity 32 and a center hole of the rotor body 31. On that occasion, distances from the virtual line 69 in a direction perpendicular to an inner wall of the body 51; namely, breadths a1 to a8, sequentially become greater with an increasing proximity from a point on the innermost circumference side toward the outer circumference side of the body.When the virtual line 69 is taken as a reference, the breadths become greater up to at least a position that is one-half or more the distance from the inner circumference side; namely, a 68% position that is in excess of two-thirds of the distance in the embodiment. Such a specimen container 51 having a greater spread in its lateral direction with an increasing proximity in the direction of centrifugal direction is helpful in effecting efficient, highly-accurate centrifugal separation. Specifically, since particles can hardly move along the wall of the container, the particles can smoothly move, and a time of centrifugal separation can be shortened. Further, a band including particles having a uniform specific gravity can be neatly produced within a short period of time.

Figure 16:
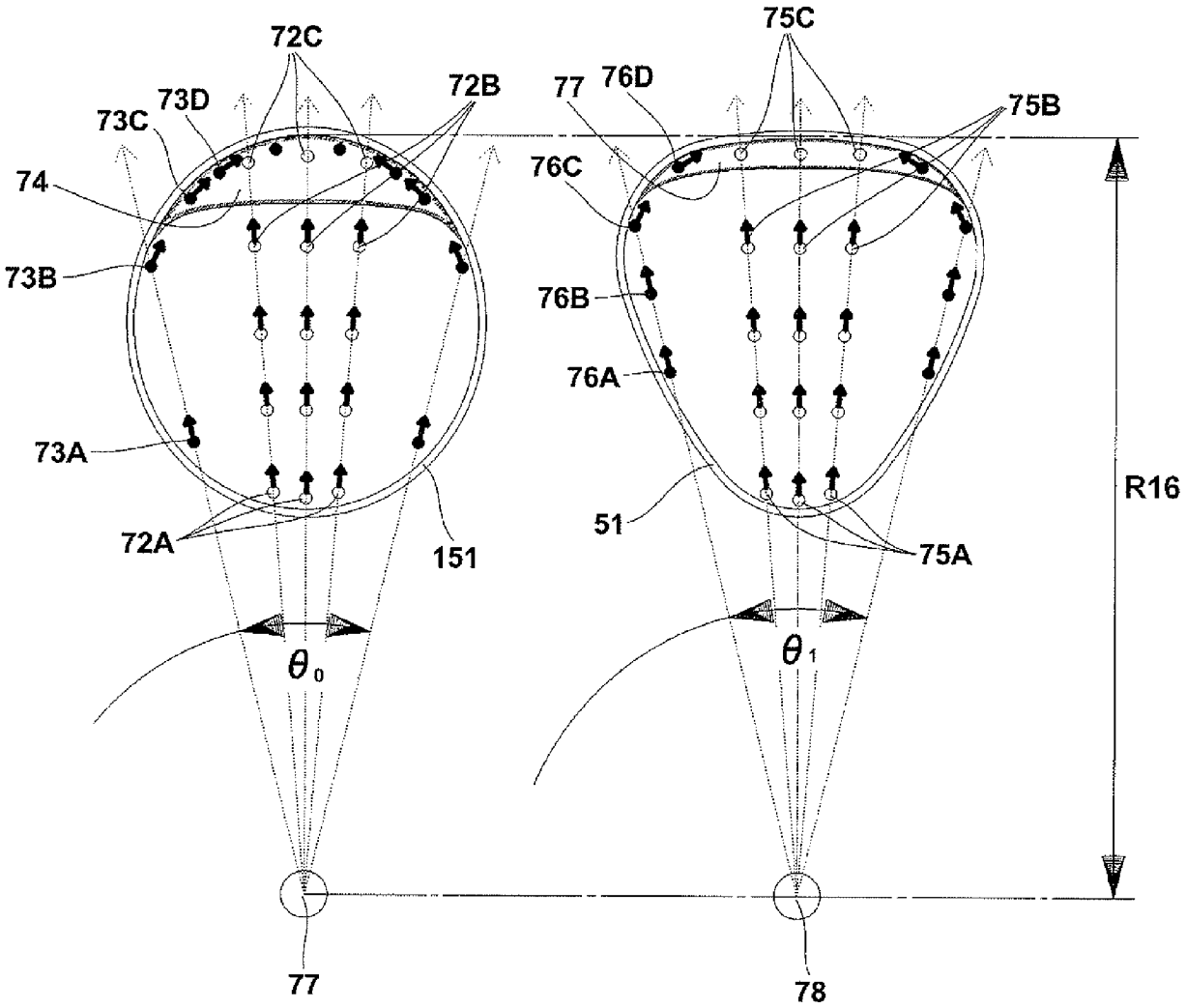
FIG. 16 is a diagrammatic view showing a state of centrifugal separation achieved by the specimen container of the present invention and a state of centrifugal separation achieved by the related-art circular specimen container.

FIG. 16 provides an additional explanation about the state. FIG. 16 is a view showing a state of centrifugal separation effected by the specimen container 50 of the present invention and a state of centrifugal separation effected by the related-art circular specimen container 150. For the sake of comprehension of the present invention, particles are schematically drawn in large size. Further, the illustrations are drawn so as to become equal to each other in terms of the size of the rotor (relevant to a radius R16 in the drawing) and angles $\theta_0$ and $\theta_1$. A left-side transverse cross section designated by an oval shows the body 151 of the specimen container 150, and a substantially triangular transverse cross section, like the shape of a riceball, on the right side shows the body 51 of the specimen container 50 of the embodiment. During centrifugal separation, particles that are present in the bodies 151 and 51 of the specimen containers move toward the outer circumference of the rotor by means of centrifugal force stemming from rotation of the rotor. A point 77 shows the position of the rotation center of the specimen container 150, and a point 78 designates a position of rotation center of the specimen container 50. The point 78 coincides with a position of the screw hole 31H shown in FIGS. 4 and 5.

In the related-art specimen container provided on the left side, particles 72A located on the inner circumference side move toward the outer circumference side by means of rotation of the rotor, to thus pass through positions of particles 72B and further move to positions of particles 72C on the outer circumference side. In the meantime, particles 73A located in the vicinity of a circumference side surface of the specimen container 150 likewise move to positions of particles 73B, thereby colliding against the wall of the specimen container 150 and further moving along the wall as do particles 73C and 73D. As mentioned above, as a result of high-density particles (heavy particles) contained in a specimen moving toward the outer circumference side, the particles build up as a pellet 74.

In the specimen container of the embodiment provided on the right side, particles 75A located on the inner circumference side move toward the outer circumference side by rotation of the rotor, to thus pass through positions of particles 75B and further move to positions of particles 75C on the outer circumference side. In the meantime, particles 76A located in the vicinity of a circumference side surface of the specimen container 50 likewise move to positions of particles 76B and 76C, thereby colliding against the wall of the specimen container 50 and further moving along the wall as do particles 76D. As mentioned above, as a result of high-density particles (heavy particles) contained in a specimen moving toward the outer circumference side, the particles build up as a pellet 77.

A comparison between the specimen containers shows that the particles come together at the center of the container along the wall from the positions of the particles 73B to 73D because the related-art specimen container 50 has a circular wall and that centrifugal separation must be carried out for a long period of time because the particles hardly move because of friction between the particles and the wall. In the mean time, when the specimen container 50 is substantially triangular as in the present embodiment, a degree of collision of the particles 76C against the wall is considerably small. Even when there are particles that move along the wall, a distance over which the particles are to move along the wall becomes shorter. Accordingly, the centrifugal separation time becomes shorter. When a single specimen is subjected to separation, a centrifugal separation effect is improved.

Figure 17:
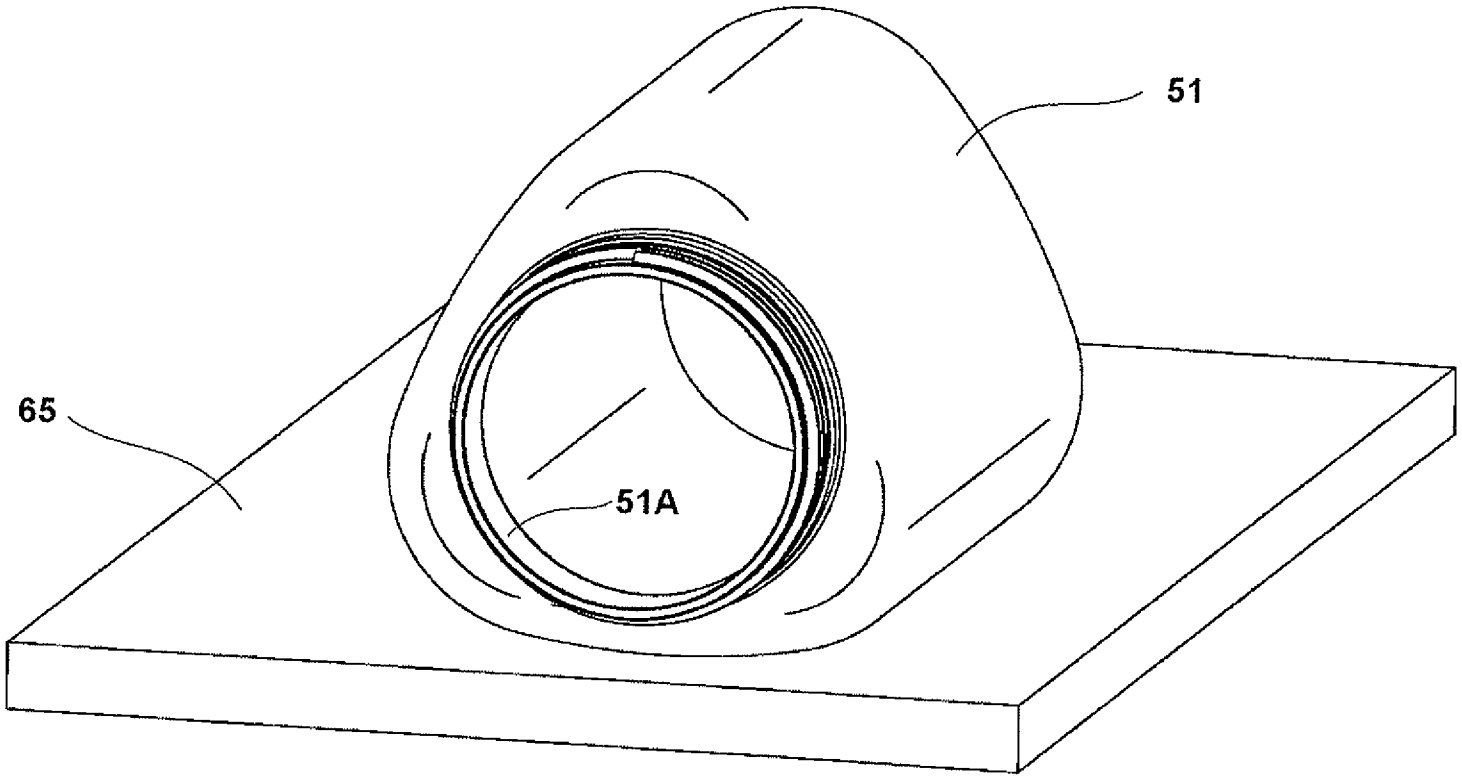
FIG. 17 is a view showing that the specimen container 50 of the embodiment of the present invention is laid on its side.

After completion of centrifugal separation, work is often performed to take out the precipitated pellets 77 in the specimen container 50 with the specimen containers laid on their sides. FIG. 17 shows that the cap 52 of the specimen container 50 of the embodiment is removed and that the body 51 is laid on its side on a mount surface 65. The drawings do not illustrate the precipitated pellets 77. However, when the container is laid on its side, the container can be placed on the floor with its side portion, where the pellets 77 are precipitated, down. On this occasion, the specimen container 50 does not roll because the body 51 has a substantially triangular transverse cross section. Hence, since it is possible to stably perform work on the mount surface 65, superior workability is accomplished. In particular, even when the pellet is raked out and transferred to another container, laying the body 51 on its side makes it easy to perform raking work, so that the specimen container is advantageous. In order to prevent rolling of the specimen container 50, it is desirable to set the curvature radius R2 of the sides 56A, 56B, and 56C to 170 mm or more.

As mentioned above, a large amount of specimen can be processed at a time by use of the rotor 30 and the specimen container 50 of the present embodiment. Further, since the specimen container 50 of the present embodiment is structured so as to spread toward the outer circumference, positions where particles located in the neighborhood of the wall reach the wall surface become much closer to the outer circumference, so that influence of friction which the particles undergo while moving along the wall surface can be lessened. Further, the outer shape of the body 51 of the specimen container 50 is made substantially triangular rather than circular. Therefore, there is yielded an advantage of a worker being able to easily turn the cap 52 even when holding the body 51 by one hand and turning the cap 52 by the other hand. In particular, after centrifugal separation, specimens are often cooled as a result of the rotor chamber 4 has been cooled, and the withdrawn specimen containers 50 are covered with water droplets. However, even in the case of the wet specimen containers 50, there is yielded an advantage of the body 51 being easy to hold by means of the three vertices 55A, 55B, and 55C.

[Second Embodiment]

Figure 18:
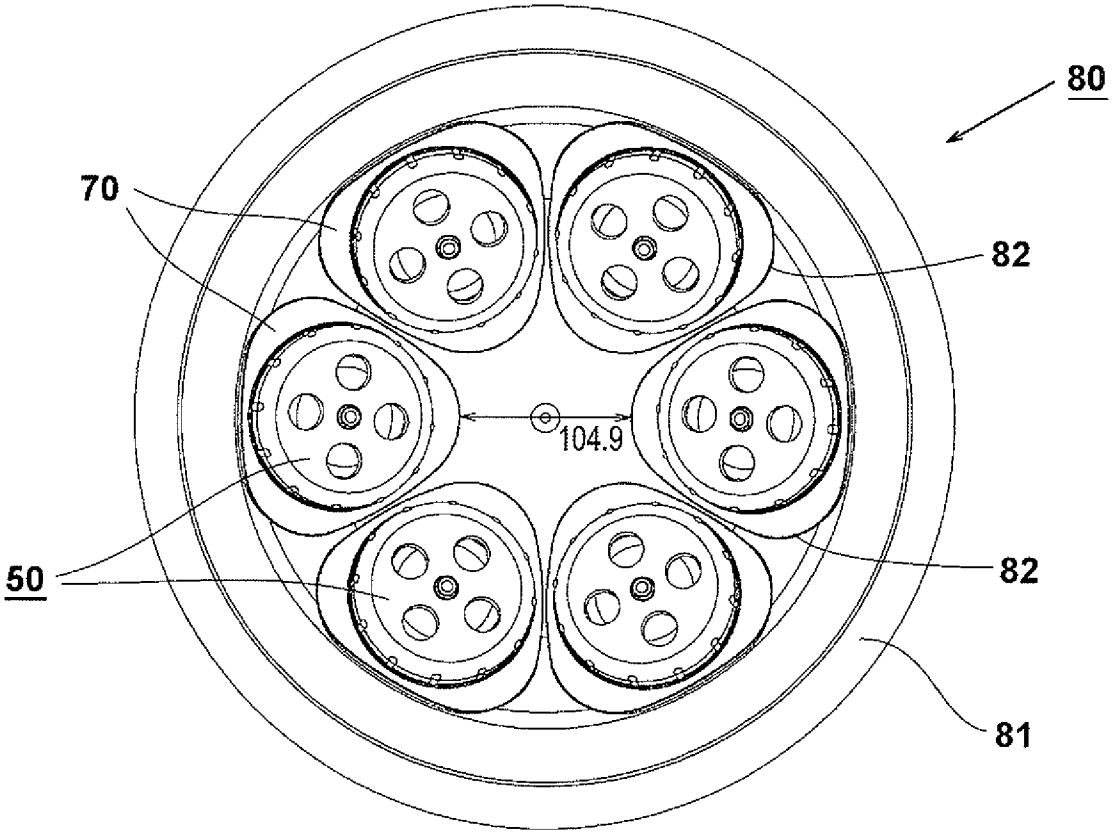
FIG. 18 is a top view of a rotor 80 of a second embodiment of the present invention equipped with the specimen container 50 and the neck support member 70.

A second embodiment of the present invention is now described by reference to FIG. 18. FIG. 18 shows that six specimen containers 50 can be accommodated by shortening spacing between holding cavities 82 formed in a rotor 80. By means of the structure, spacing between adjacent holding cavities 82 is much shortened, so that useless spacing becomes smaller. It is desirable that a mount angle of the specimen container 50 of the second embodiment be made smaller than that shown in FIG. 12. It is better to set the mount angle to 15° or more and under 20°. In the present embodiment, the mount angle is set to 17°, and the specimen containers 50 are inserted so as to assume a slightly upright attitude, thereby preventing occurrence of interference between the adjacent specimen containers 50, which would otherwise arise during insertion or removal of the containers. As a consequence, when the diameter of the largest thickness portion of the rotor 80 is 431 mm, a distance between opposing neck support members 70 achieved along the innermost circumference side comes to 104.9 mm, or thereabouts, as illustrated. As mentioned above, in the second embodiment, one rotor 80 is structured so as to enable attachment of six specimen containers 50 each having a capacity of 1500 ml. Therefore, it is possible to subject as much as nine lifters of specimens to centrifugal separation by one operation of centrifugal separation.

[Third Embodiment]

Figure 19A:
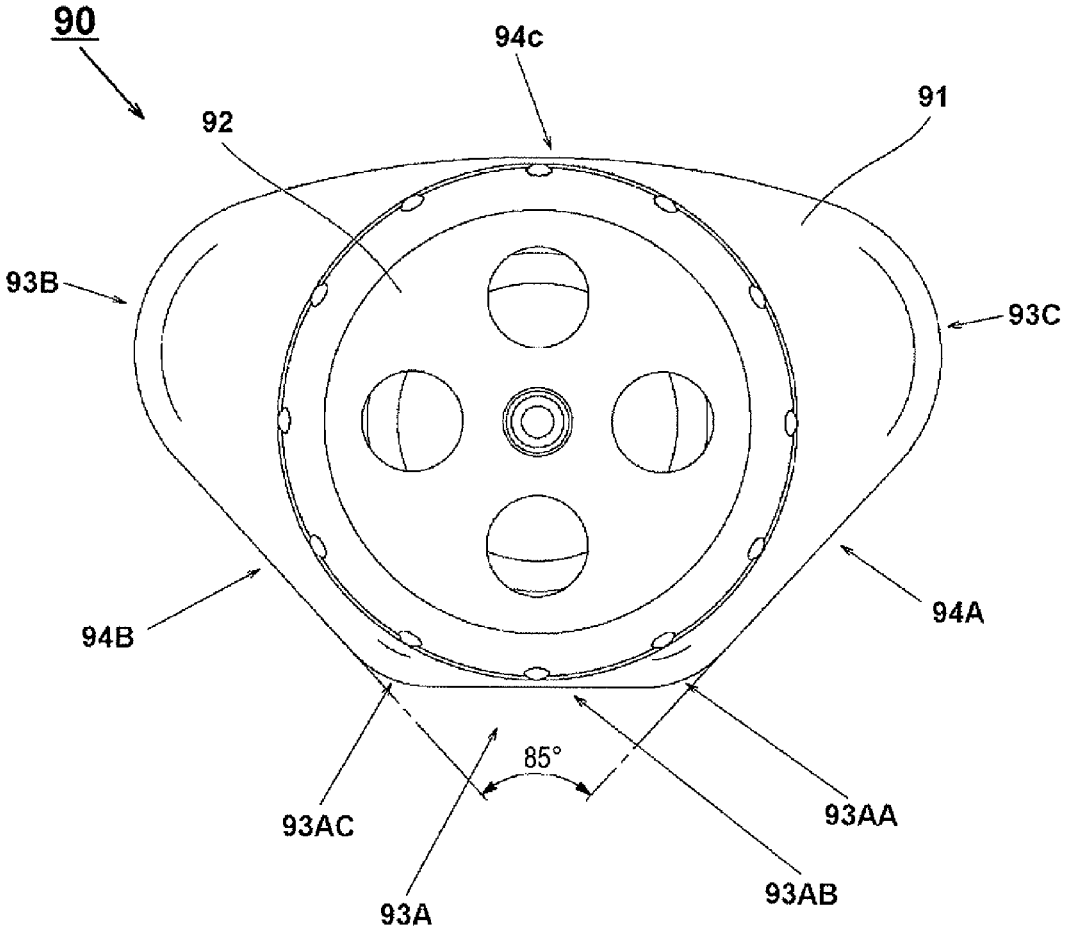

A specimen container 90 of a third embodiment of the present invention is now described by reference to FIGS. 19A and 19B. When viewed from above, a body part 91 of the specimen container 90 assumes a substantially-fan-shaped form. The specimen container is arranged such that a rotation center of the rotor is located down in the drawing. In FIG. 19A, the specimen container 90 is configured such that an angle of a first vertex 98A located on an inner circumference side is increased and that the first vertex 93A is not formed at a single curvature radius but from two curved surfaces having curvature radii 93AA and 93AC and a side 93AB interconnecting the curved surfaces. The reason for the side 93AB being formed is that the specimen container is attached as nearly as possible the rotary shaft side of the rotor. A contour of the side 93AB may be a straight shape or a gently-curved shape.

Sides 94A and 94B connected to both sides of the first vertex 93A are formed in a plane shape in the present embodiment but may also be configured in a gently-curved shape. A side 94C located on the outer circumference area is formed from a curved surface exhibiting gentle roundness outside. A second vertex 93B and a third vertex 93C located on both sides of the side 94C are formed from curved surfaces having a curvature radius that is smaller than a curvature radius of an outer shape of a cap 92.

Figure 19B:
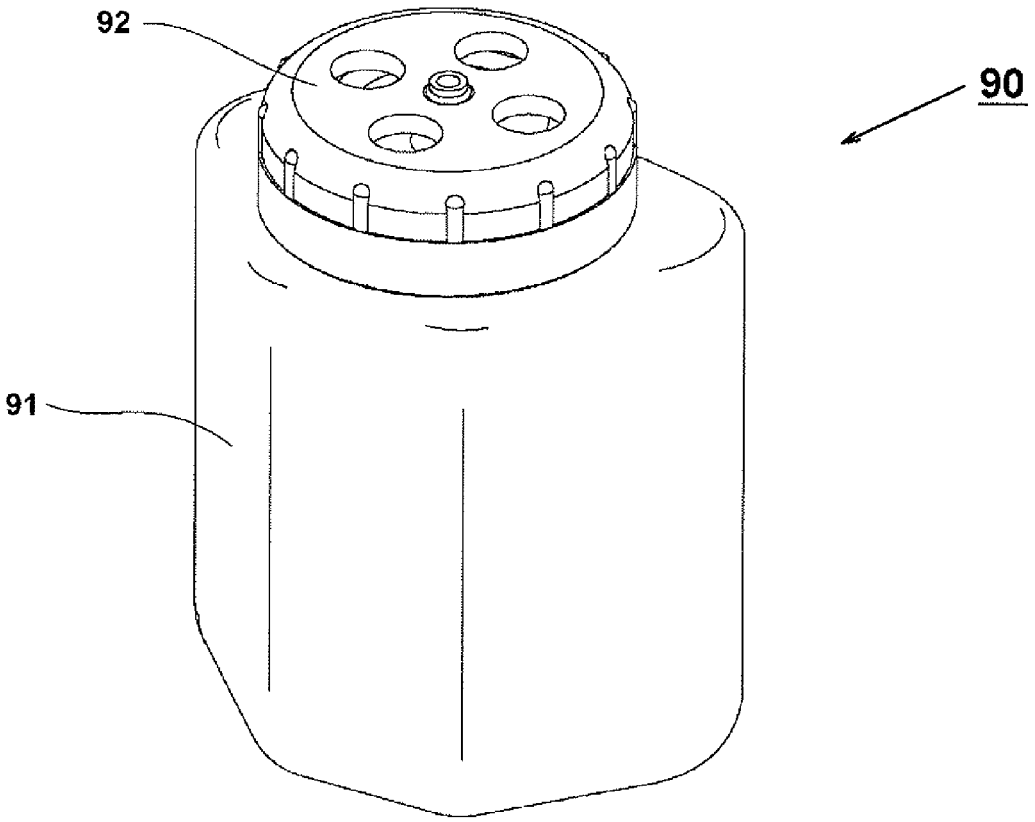

FIG. 19B is an oblique perspective view of the specimen container 90. The specimen container 90 of the embodiment is configured in a shape optimum for attachment of four specimen containers to the rotor. When the specimen container 90 is used, a direction of insertion of the container to the holding cavity of the rotor is limited to a specific single direction. However, in compensation for such a disadvantage of the limited direction, there can be yielded an advantage of the capability of accomplishing the maxim specimen capacity of a container despite a limited volume of the rotor. Further, a degree of flatness of the shape of the rotor can be increased by use of the specimen container 90, so that stability achieved during rotation can be enhanced.

[Fourth Embodiment]

Figure 20A:
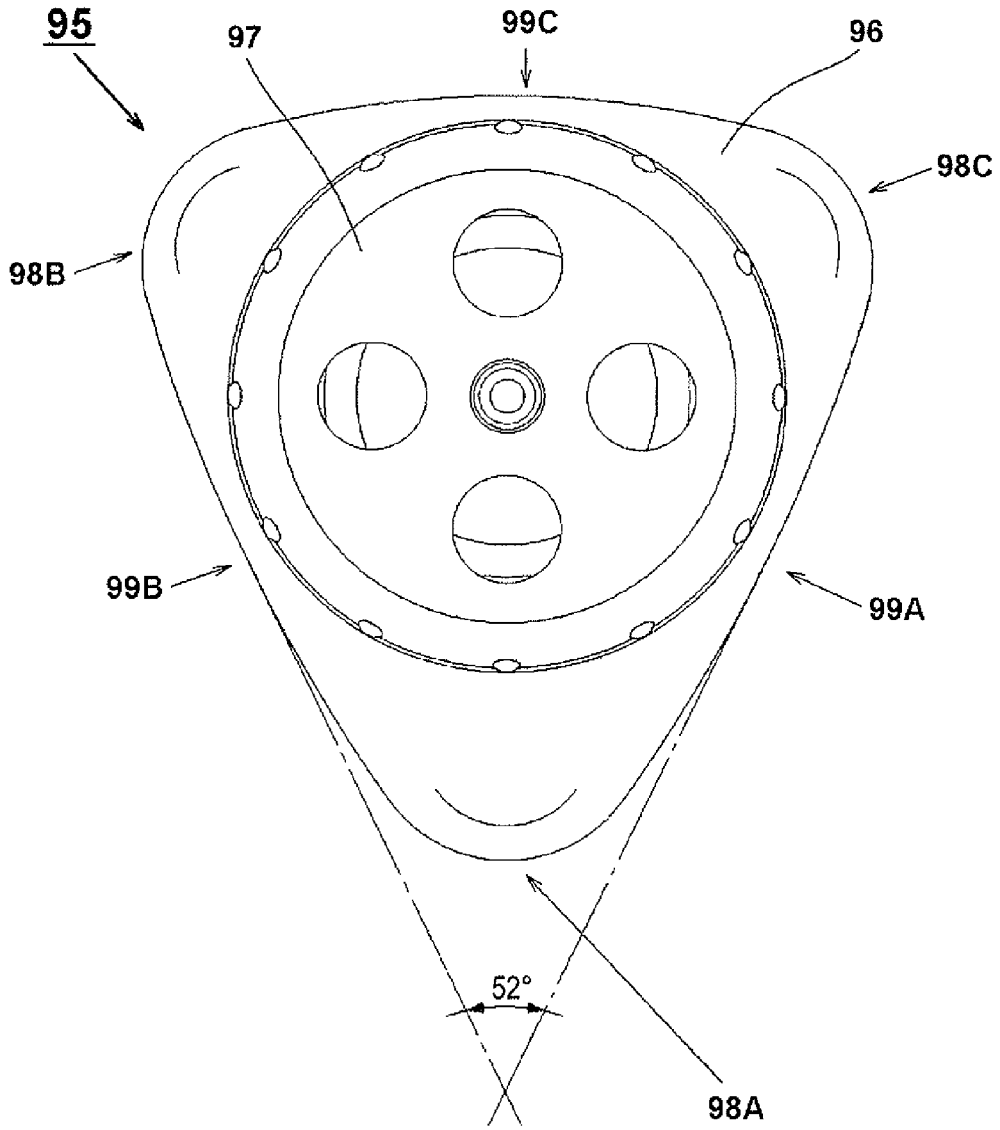

A specimen container 95 of a fourth embodiment of the present invention is now described by reference to FIGS. 20A and 20B. When viewed from above, a body part 96 of the specimen container 95 assumes a substantially isosceles triangle. The specimen container 95 is arranged such that a rotation center of the rotor is arranged down in the drawing. In FIG. 20A, the specimen container 95 is configured such that an angle of a first vertex 98A located on the inner circumference side is made smaller and that an interior angle formed by tangential lines of sides 99A and 99B connected to both sides of the first vertex is set to 52°. Although the sides 99A and 99B are made in the form of considerably-gentle curved surfaces but may also be made in a planer shape. A side 99C located on the outer circumference side is formed from a curved surface exhibiting gentle roundness outside. Second vertices 98B and 98C located on both sides of the side 99C are made in the form of a curved surface having a curvature radius that is smaller than that of an outer shape of a cap 97.

Figure 20B:
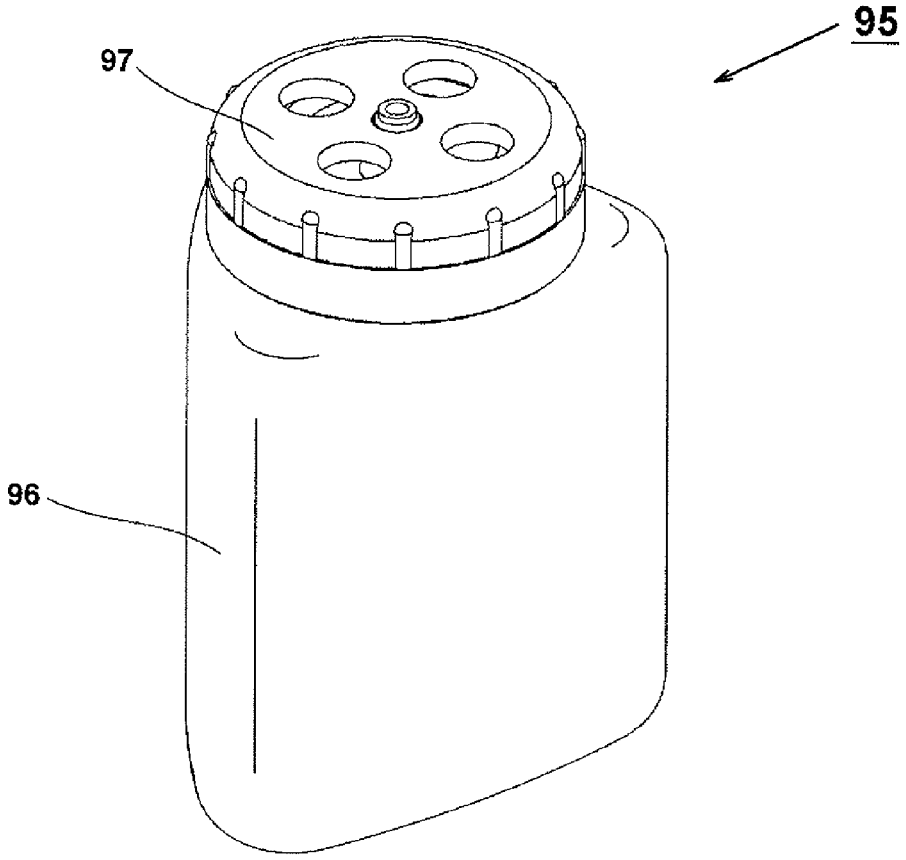

FIG. 20B is an oblique perspective view of the specimen container 95, and six specimen containers 95 can be attached to the rotor. In that case, the angle θ can be set to a value of about 23° as is the angle θ shown in FIG. 12. When the specimen container 95 is used, a direction of insertion of the container to the holding cavity of the rotor is limited to a specific single direction. However, in compensation for such a disadvantage of the limited direction, there can be yielded an advantage of the capability of accomplishing the maxim specimen capacity of a container despite a limited volume of the rotor. In the present embodiment, the angle of the vertex 98A located on the inner circumference side is under 60°; specifically, 52°, there can be embodied a rotor for a centrifugal separator that enables arrangement of six specimen containers or more in a circumferential direction.

In the embodiment of the present invention set forth, the outer circumference portion of the bottom of the specimen container is set so as to keep a curved parallel position with respect to an outer radius of the rotor, thereby effectively utilizing a positional relationship with the rotor of the holding cavity. Effective elimination of pads from the rotor is thereby accomplished, and the amount of specimen subject to centrifugal separation can be increased. Moreover, by means of the specimen container whose transverse cross sectional shape is a substantially equilateral triangular shape, spacing between adjacent holding cavities in the rotor is not much reduced regardless of an increase in the amount of specimen that can be contained. Therefore, the specimen container is also advantageous even in terms of maintenance of strength of the rotor.

Further, so long as there is adopted the structure of the present invention, the cavities for holding specimen containers can be machined through the same machining process as that through which the rotor is machined. In general, in order to realize non-cylindrical holding cavities, the cavities are configured such that the containers are held in the cylindrical cavities by way of adapters made of resin, or the like. However, the rotor body of the present embodiment obviates a necessity for addition of adapters, and there can be provided a comparatively inexpensive rotor for a centrifugal separator including a smaller number of components.

The substantially equilateral triangular shape of the body of the specimen container provides three directions that allow insertion of the containers into the rotor. Accordingly, the vertex exposed to the space 62 during centrifugal separation and the side where the pellet comes together do not concentrate to a specific vertex or a side. Therefore, even when the specimen containers are repeatedly used many times, a problem of only specific areas being deteriorated hardly arises.

Further, since the curvature radius of the vertex of the specimen container has a comparatively small dimension, rigidity of the vertex is extremely high. Therefore, even when centrifugal separation operation is performed while an amount of specimen is small and while a large amount of air layer is at an interior position on the center side of the rotor, the specimen container yields an advantage in terms of strength.

When the above-described embodiments are practiced, it is not necessary to make great alterations to a main unit of the centrifugal separator except countermeasures to increase the strength of the rotor against the centrifugal load exerted on the rotor resultant from an increase in capacity and except enhancement of motor strength. It is comparatively, easily possible to accomplish increased capacity by changing solely the rotor and the specimen container.

Although the embodiments showing the present invention have been described thus far, the present invention is not limited to the embodiments and susceptible to various alterations without departing the gist of the invention. For instance, although the rotor is manufactured by means of integral molding in the embodiments, the rotor may also be separately manufactured. Alternatively, members defining the holding cavities for holding containers may also be formed from adapters of members other than the rotor main body, and the adapters may also be made removably attachable to the rotor main body.

Moreover, the specimen containers having a substantially triangular transverse cross section are embodied in the present embodiments. However, the shape of the container is not limited solely to a triangle. Even when the specimen containers are given a shape based on an odd-numbered polygonal shape, such as a pentagon and a heptagon, the containers can likewise be materialized. Furthermore, even in the case of a quadrangle, an analogous advantage is yielded, so long as an inner-circumference-side side is made short; an outer-circumference-side side is made longer; and spacing interconnecting the sides is made greater toward the outer circumference side, as shown in FIGS. 19A and 19B.

What is claimed is:

1. A centrifugal separator comprising:

a plurality of specimen containers;

a rotor having a plurality of holding cavities for holding each of the plurality of specimen containers, respectively;

a drive unit that rotates the rotor; and a rotor chamber that accommodates the rotor;

wherein a transverse cross sectional shape of each of the plurality of holding cavities is a substantially triangular shape having one vertex on an inner circumference side of the rotor, wherein two vertices of the substantially triangular shape are arranged on an outer circumference side of the rotor so as to have equidistance from a rotary shaft of the rotor, and wherein a spacing between sides of the substantially triangular shape in a circumferential direction of the rotor gradually increases over 60% or more a radial length of the holding cavity from an innermost circumferential position to the outer circumference side of the rotor when viewed in its transverse plane, wherein a transverse cross sectional shape of each of the specimen containers is a substantially equilateral triangle, and each of the plurality of specimen containers are configured to be inserted into each of the plurality of holding cavities which are arranged at a plurality of positions in a circumferential direction, and wherein a diameter of the rotor is between 350 mm and 450 mm, a height of the rotor body is between 200 mm and 250 mm, and a specimen capacity of each of the plurality of specimen containers is greater than 1200 ml.

2. The centrifugal separator according to claim 1, wherein tangential lines of two sides that form the vertex located on the inner circumference side of the substantial triangle make an angle of 45° or more and under 90°.

3. The centrifugal separator according to claim 2, wherein each angle made by two of tangential lines of the respective sides of the holding cavity is 60°.

4. The centrifugal separator according to claim 1, wherein the rotor is formed from a metallic alloy by integral molding, and each of the plurality of holding cavities is formed so as to tilt with respect to a rotary shaft of the rotor such that a center axis of each of the plurality of holding cavities extends from the rotary shaft of the rotor in a downward direction.

5. A centrifugal separator comprising:

a plurality of specimen containers;

a rotor having a plurality of holding cavities for holding each of the plurality of specimen containers, respectively;

a drive unit that rotates the rotor; and a rotor chamber that accommodates the rotor;

wherein a horizontal transverse cross sectional shape of each of the plurality of holding cavities is a substantial triangle having three vertices, wherein in relation to vertical arrangement of each of the plurality of holding cavities, each of the plurality of holding cavities the holding cavity is formed so as to tilt with respect to a rotary shaft of the rotor such that a turning radius of each of the plurality of holding cavities becomes greater from an opening in an upper portion to a bottom of the hole, and wherein each of the plurality of holding cavities is configured such that, when each of the plurality of specimen containers is inserted into the holding cavity, a distance (L1) between a vertical center line of each of the plurality of specimen containers and an inner wall on an inner side of each of the plurality of specimen containers becomes greater than a distance (L2) between the vertical center line and an inner wall on an outer side of each of the plurality of specimen containers, within a longitudinal cross section including the vertical center line of each of the plurality of specimen containers and the rotary shaft of the rotor.

6. The centrifugal separator according to claim 5, wherein each of the plurality of holding cavities is arranged such that one of the three vertices lying in the transverse plane is located on an innermost circumference of the rotor and that remaining two vertices are located on an outer circumference side of the rotor so as to have equidistance from the rotary shaft of the rotor.

7. The centrifugal separator according to claim 6, wherein each of the plurality of specimen containers whose transverse cross sectional shape has three vertices can be inserted into each of the plurality of holding cavities, and a cap having a circular opening, is fitted to a top of each of the plurality of specimen containers for closing an opening of each of the plurality of specimen containers.

8. The centrifugal separator according to claim 7, wherein, in the opening of each of the plurality of specimen containers, a distance between the vertical center line and the inner wall on the inner side of the opening of each of the plurality of specimen containers is equal to a distance between the vertical center line and the inner wall on the outer side of the opening of each of the plurality of specimen containers.

9. The centrifugal separator according to claim 7, wherein the three vertices of each of the plurality of specimen containers are made at a curvature radius that is smaller than an outer diameter of the cap.

10. The centrifugal separator according to claim 7, wherein each of the plurality of holding cavities is formed such that an arbitrary one of the three vertices of each of the plurality of specimen containers is located on the innermost circumference side of each of the plurality of holding cavities.

11. A rotor for use in a centrifugal separator, comprising:

a rotor body having a plurality of cavities for holding specimen containers, each of the cavities being discrete chambers bored in the rotor body and which are separated from one another by wall portions;

wherein a transverse cross sectional shape of each of the cavities is a substantially triangular shape having three sides and three vertices;

wherein each of the cavities is arranged such that one of the three vertices lying in the transverse plane is located on an innermost circumference of the rotor body and the remaining two vertices are located on an outer circumference side of the rotor body so as to have equidistance from a rotary shaft of the rotor body; and wherein each of three vertices is formed to have a small-arc shape of curvature radius R1 and each of three sides is formed to have a circular-arc shape of radius R2 which is greater than R1.

12. The rotor according to claim 11, further comprising:

a rotor cover formed in an upper portion of the rotor body.

13. The rotor according to claim 11, wherein spacing between the two sides of the substantially triangular shape in a circumferential direction of the rotor body gradually increases over 60% or more of a radial length of the cavity from an innermost circumferential position to the outer circumference side of the rotor when viewed in its transverse plane.

14. The rotor according to claim 11, wherein the wall portions include a thinned portion that is made by downwardly boring a center area of the rotor body.

15. A centrifugal separator comprising:

the rotor according to claim 11; comprising:

a driver unit that rotates the rotor body; and a chamber for accommodating the rotor body.

16. A rotor for use in a centrifugal separator, comprising:

a rotor body having a plurality of cavities for holding specimen containers, each of the cavities being discrete chambers bored in the rotor body and which are separated from one another by wall portions;

wherein a transverse cross sectional shape of each of the cavities is a substantially triangular shape having three sides and three vertices;

wherein each of the cavities is arranged such that one of the three vertices lying in the transverse plane is located on an innermost circumference of the rotor body and the remaining two vertices are located on an outer circumference side of the rotor body so as to have equidistance from a rotary shaft of the rotor body; and wherein each of three vertices is formed to have a small-arc shape of curvature radius R1 an each of three sides is formed to have a straight line shape.

17. The rotor according to claim 16, further comprising:

a rotor cover formed in an upper portion of the rotor body.

18. The rotor according to claim 16, wherein spacing between the two sides of the substantially triangular shape in a circumferential direction of the rotor body gradually increases over 60% or more of a radial length of the cavity from an innermost circumferential position to the outer circumference side of the rotor when viewed in its transverse plane.

19. The rotor according to claim 16, wherein the wall portions include a thinned portion that is made by downwardly boring a center area of the rotor body.

20. A centrifugal separator comprising:

the rotor according to claim 16; comprising:

a driver unit that rotates the rotor body; and a chamber for accommodating the rotor body.

* * * * *